US008328447B2

(12) United States Patent
Tani

(10) Patent No.: US 8,328,447 B2
(45) Date of Patent: Dec. 11, 2012

(54) CONTAINERS FOR PUSHING OUT APPLYING MATERIAL

(75) Inventor: Yoshikazu Tani, Nakatsugawa (JP)

(73) Assignee: Tokiwa Corporation, Gifu (JP)

( * ) Notice: Subject to any disclaimer, the term of this patent is extended or adjusted under 35 U.S.C. 154(b) by 538 days.

(21) Appl. No.: 12/606,909

(22) Filed: Oct. 27, 2009

(65) Prior Publication Data

US 2010/0104346 A1 Apr. 29, 2010

(30) Foreign Application Priority Data

Oct. 29, 2008 (JP) ..... 2008-278778

(51) Int. Cl.
*B43K 5/06* (2006.01)

(52) U.S. Cl. ..... 401/172; 401/68; 401/70; 401/75

(58) Field of Classification Search ..... 401/68, 401/69, 70, 75, 171, 172
See application file for complete search history.

(56) References Cited

U.S. PATENT DOCUMENTS 6,361,233 B1 * 3/2002 Yamanaka et al. ..... 401/68
6,588,957 B2 * 7/2003 Ohba ..... 401/75
6,629,797 B1 * 10/2003 Lee ..... 401/78

* cited by examiner

*Primary Examiner* — David Walczak
(74) *Attorney, Agent, or Firm* — Hanley, Flight & Zimmerman, LLC

(57) ABSTRACT

When rotating a main body tube and an operation tube in a disclosed container toward a first direction, a moveable screw tube advances a predetermined amount. When further rotating toward the first direction, a screwing part urges a moving body forward. A female thread of the screwing part in the moveable screw tube is radially outwardly expandable via a slit. When the moveable screw tube advances toward the first direction, the outer diameter of the front end part is restricted and expansion thereof is prevented. When further rotating toward the first direction and the screwing part urges the moving body forward, expansion of the front end part and the female thread of the screwing part may be suppressed. Accordingly, the screwing part reliably exerts screw function when the moving body advances.

6 Claims, 16 Drawing Sheets

CONTAINERS FOR PUSHING OUT APPLYING MATERIAL

FIELD OF THE DISCLOSURE

The present disclosure relates generally to containers, and more particularly to containers used for pushing out applying material.

BACKGROUND

A prior art container for pushing out applying material has a moving body screwed via a screwing part on a moveable screw tube (see Patent Document 1 for example). In such a container for pushing out applying material, when the front part of the container and the rear part of the container are rotated toward one direction relative to each other, the moving body advances under the screw function of the screwing part, so that the applying material is pushed out from an opening at the front end of the container.

Patent Document 1: Gazette No. JP2008-43590

In the aforementioned container for pushing out applying material, a slit is formed at the end of the moveable screw tube constituting the female thread of the screwing part so as to radially outwardly expand. Accordingly, in the case the female thread of the moveable screw tube is formed by using a core pin (a shaping mould) for instance, it is possible not to pull out the core pin by rotation of a motor or a gear rack, but to pull the core pin perforce along the axial direction, thereby facilitating fabrication.

However, in the aforementioned container for pushing out applying material, since a slit is formed at the end of the moveable screw tube constituting the female thread as noted above, the screw function of the screwing part is sometimes not fully exerted when the screwing part urges the moving body to advance under the screw function due to different circumstances, there is the case in which the pushing strength of the applying material is not fully obtained.

DETAILED DESCRIPTION

Figure 1:
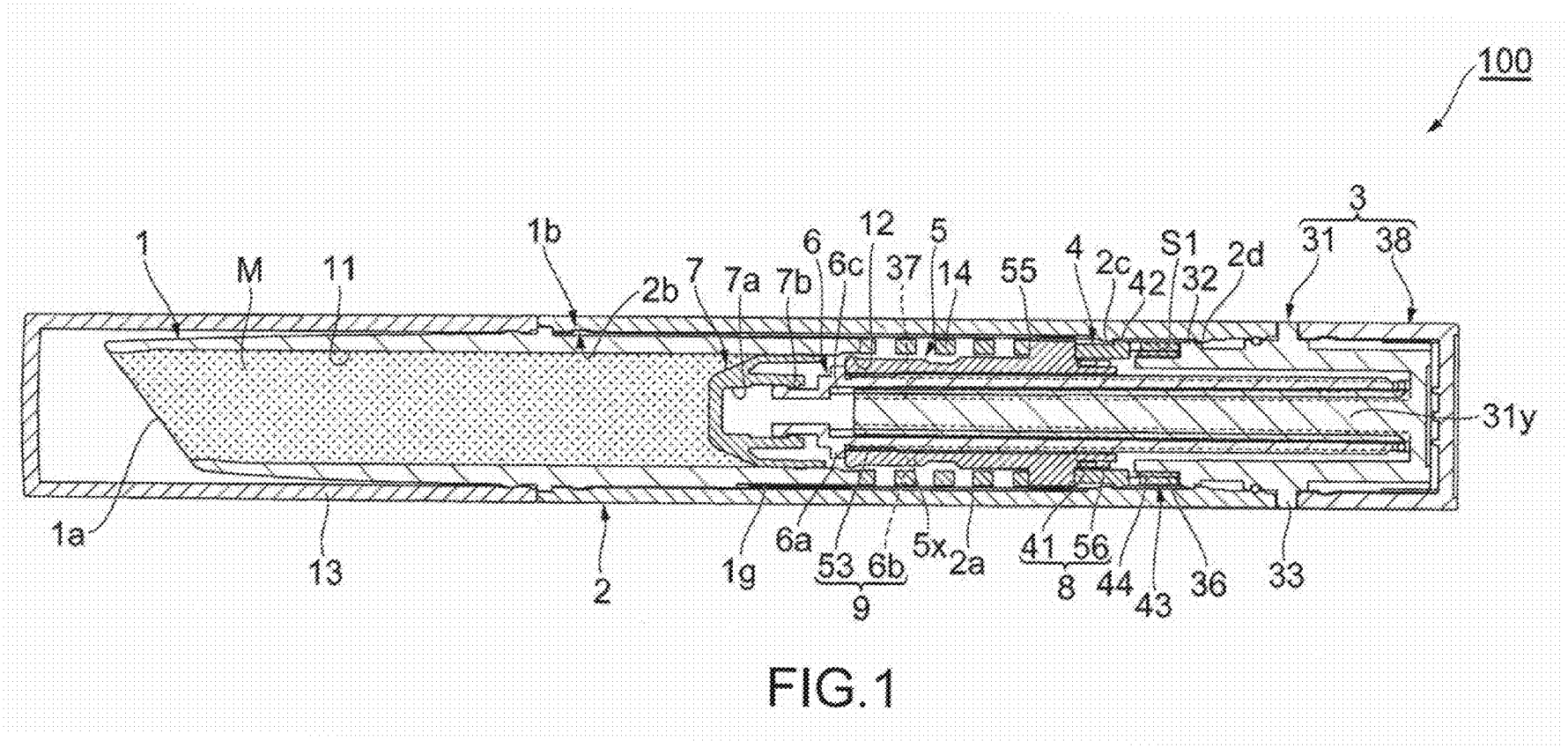
FIG. 1 is a longitudinal sectional view illustrating the initial state of a container for pushing out applying material according to an example of the present application.

1: filling member (front part of the container);
1*a*: opening;
2: main body tube (front part of the container);
3, 203: operation tube (rear part of the container);
5: moveable screw tube; 5*x*: front end part (end side);
6: moving body;
6*b*: male thread (of the second screwing part);
8: first screwing part (other screwing part);
9: second screwing part (screwing part);
41: protrusive strip (female thread of the first screwing part);
51: slit;
53: female thread (of the second screwing part);
56: protrusive strip (male thread of the first screwing part);
100, 200: container for pushing out applying material;
M: applying material Example containers are described in detail below with reference to the accompanying drawings. Identical or corresponding structures are assigned the same reference numeral in the following description to avoid repetitive explanations.

Figure 2:
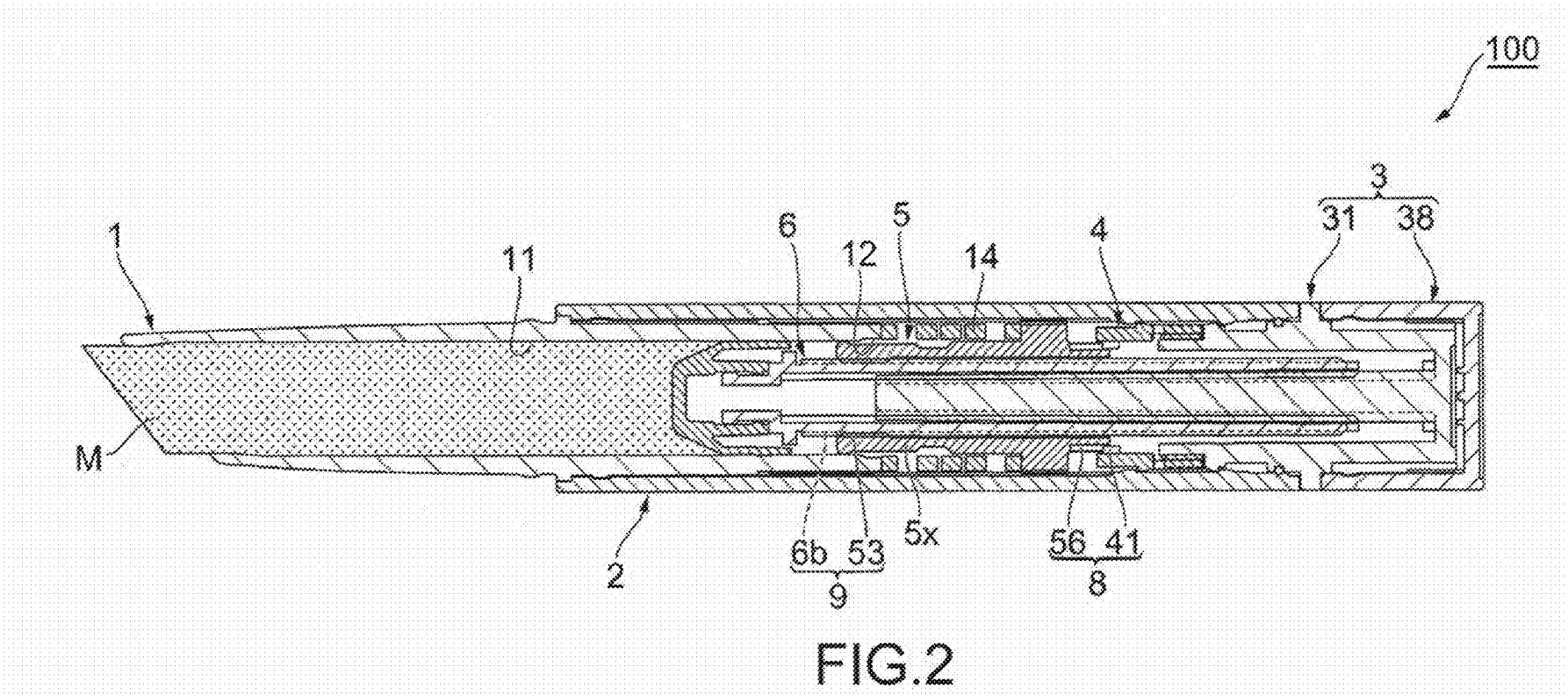
FIG. 2 is a longitudinal sectional view illustrating the state of the moveable screw tube in the advance limit in the container for pushing out applying material as shown in FIG. 1.
Figure 3:
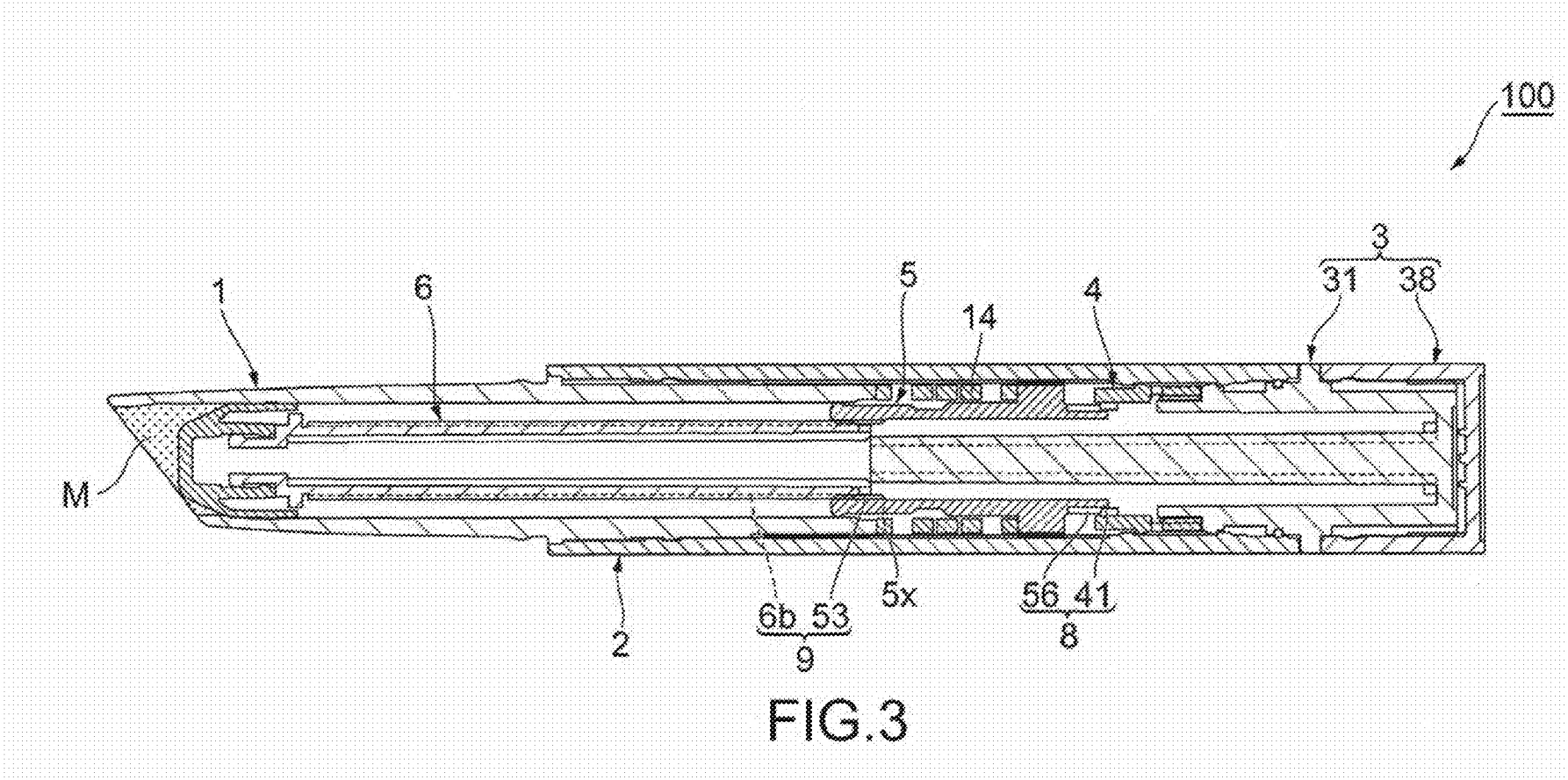
FIG. 3 is a longitudinal sectional view illustrating the state of the moving body in the advance limit in the container for pushing out applying material as shown in FIG. 1.
Figure 4:
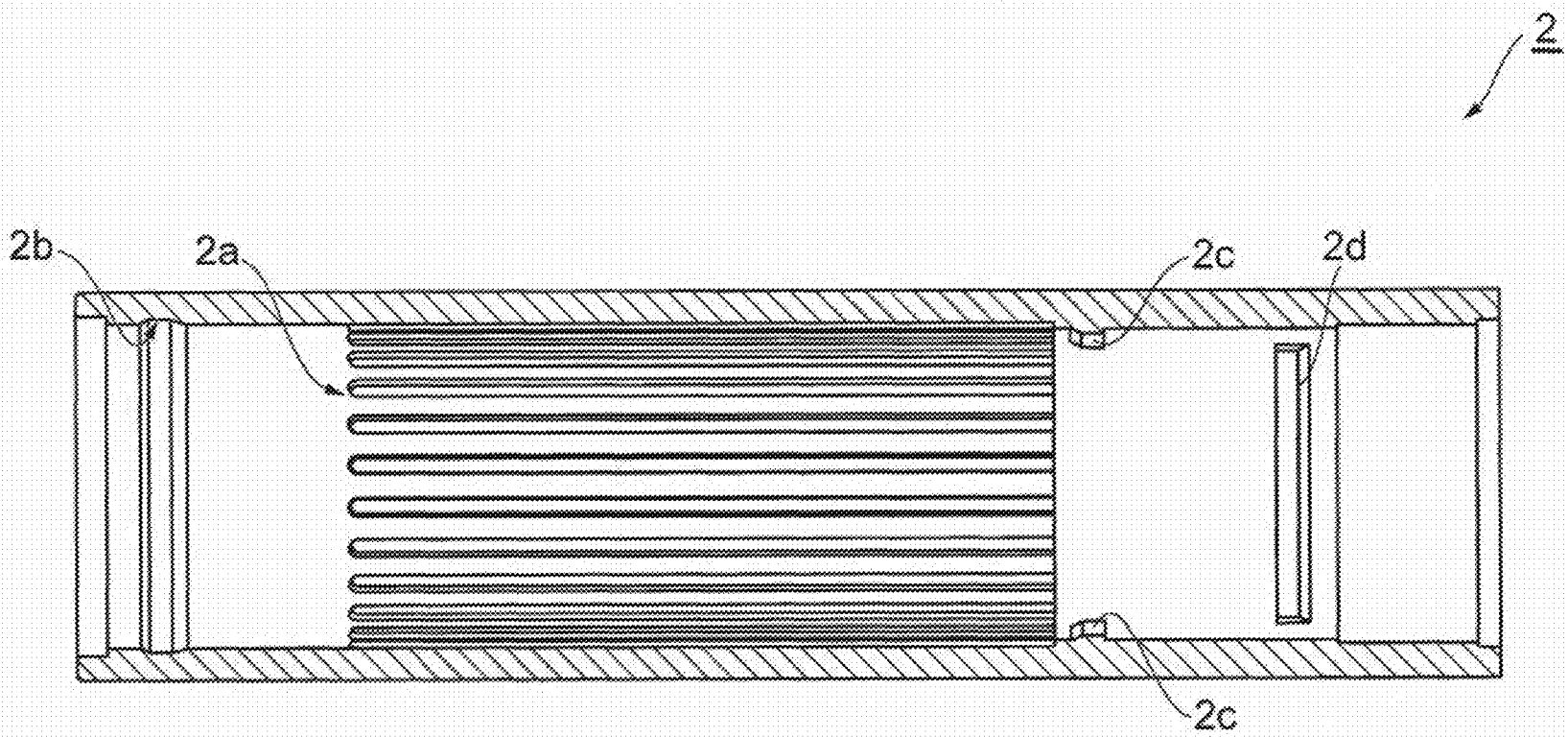
FIG. 4 is a longitudinal sectional view illustrating the main body tube of the container for pushing out applying material as shown in FIG. 1.
Figure 5:
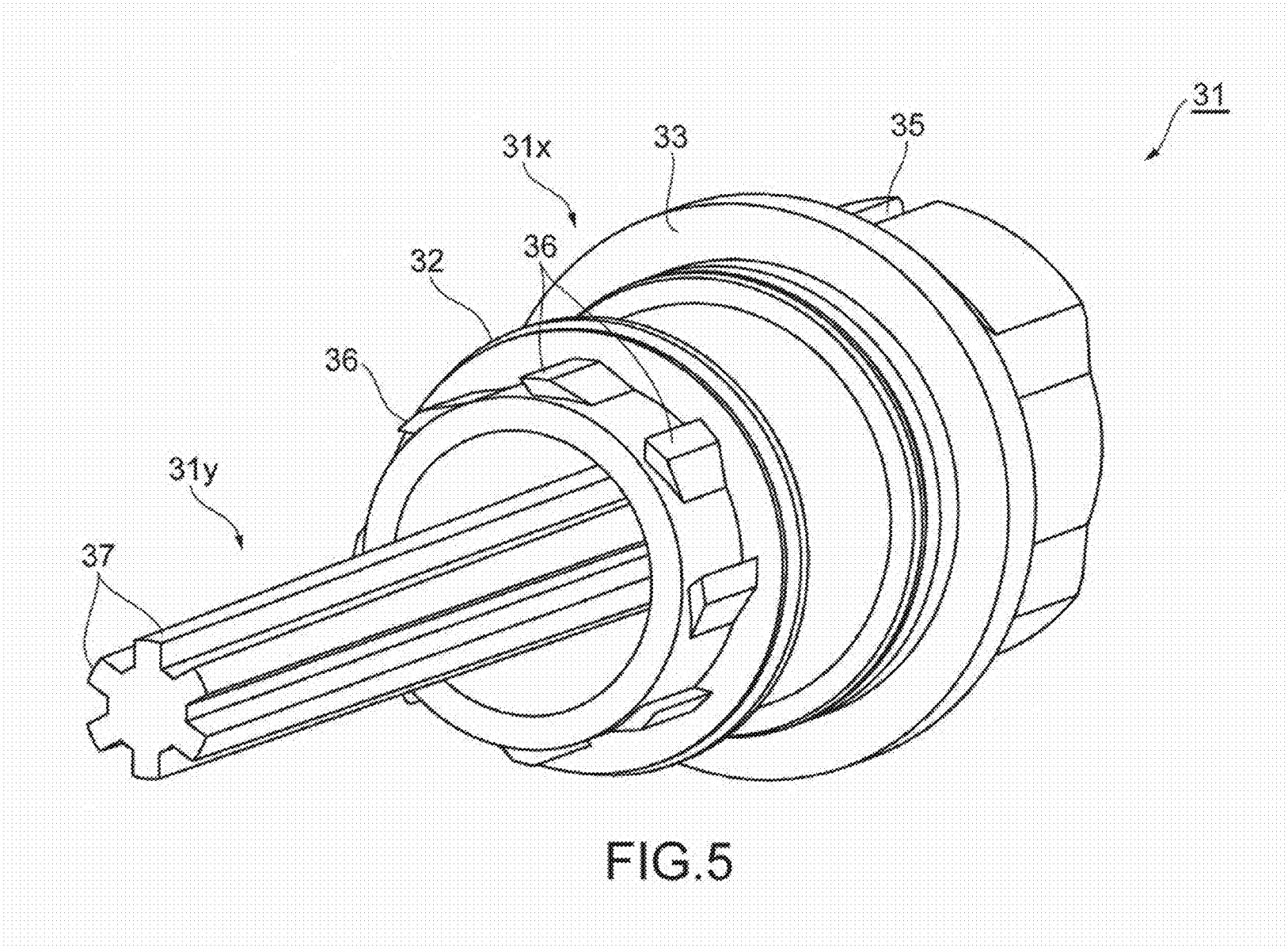
FIG. 5 is a three-dimensional view illustrating the main body part of the operation tube of the container for pushing out applying material as shown in FIG. 1.
Figure 6:
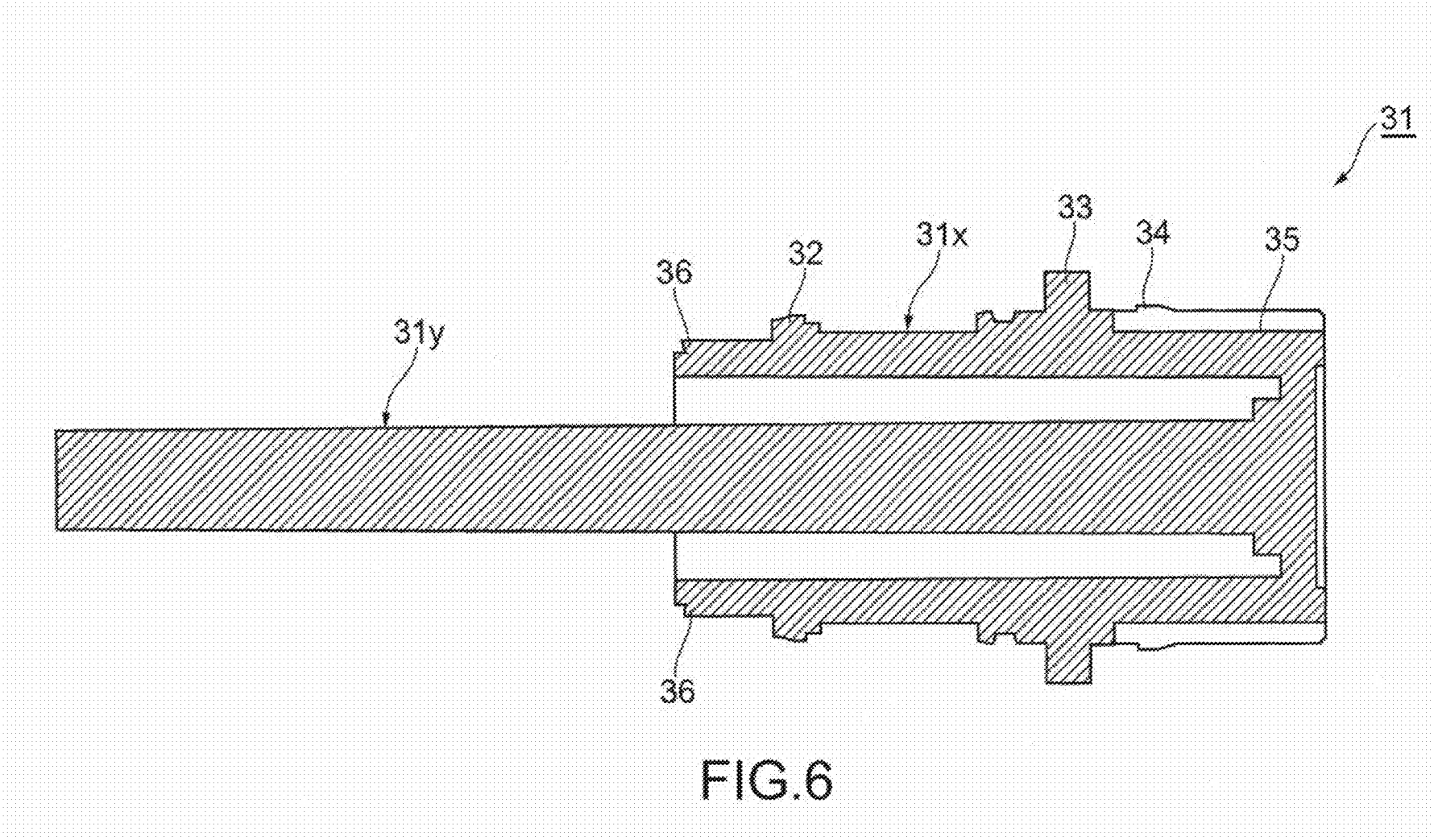
FIG. 6 is a longitudinal sectional view illustrating the main body part of the operation tube of the container for pushing out applying material as shown in FIG. 1.
Figure 7:
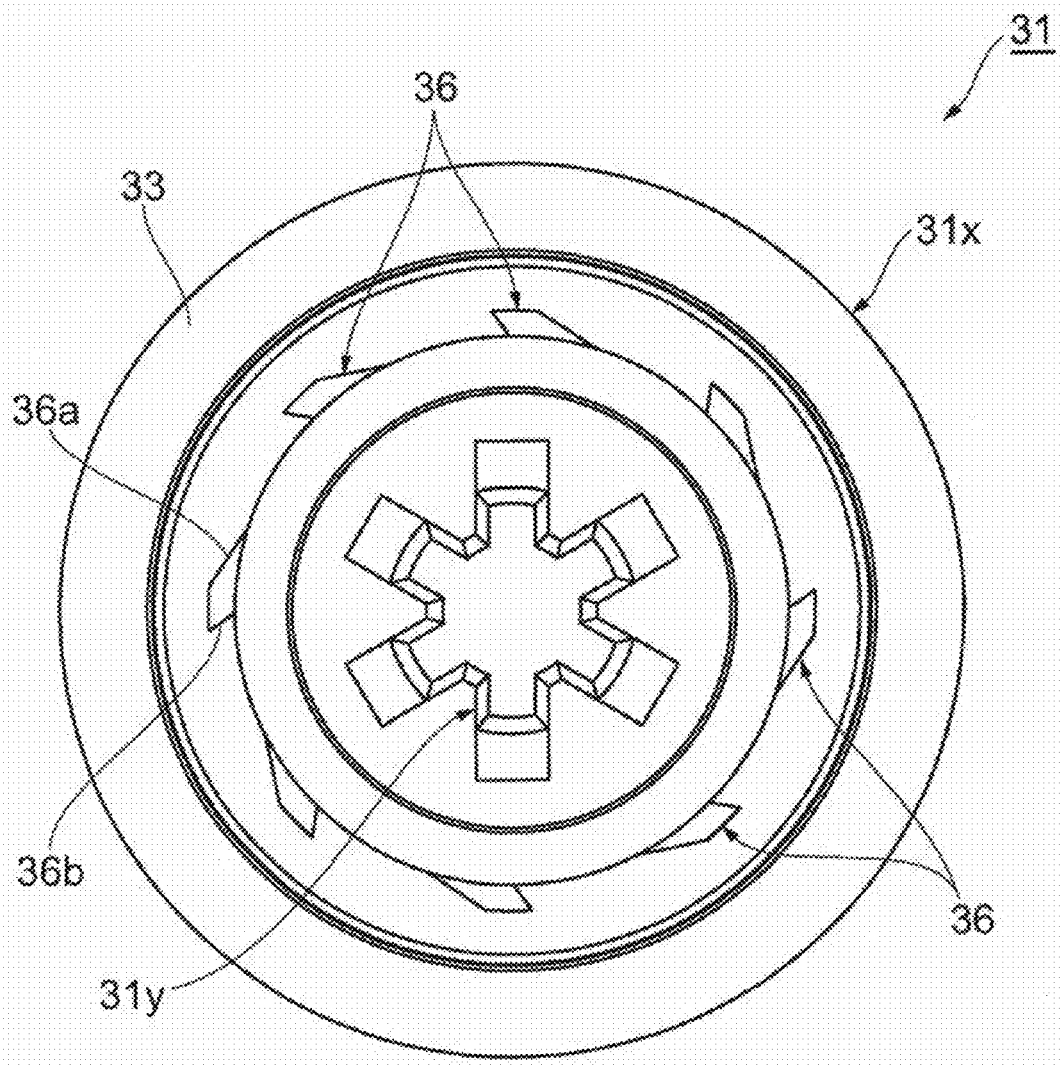
FIG. 7 is a front view illustrating the main body part of the operation tube of the container for pushing out applying material as shown in FIG. 1.
Figure 10:
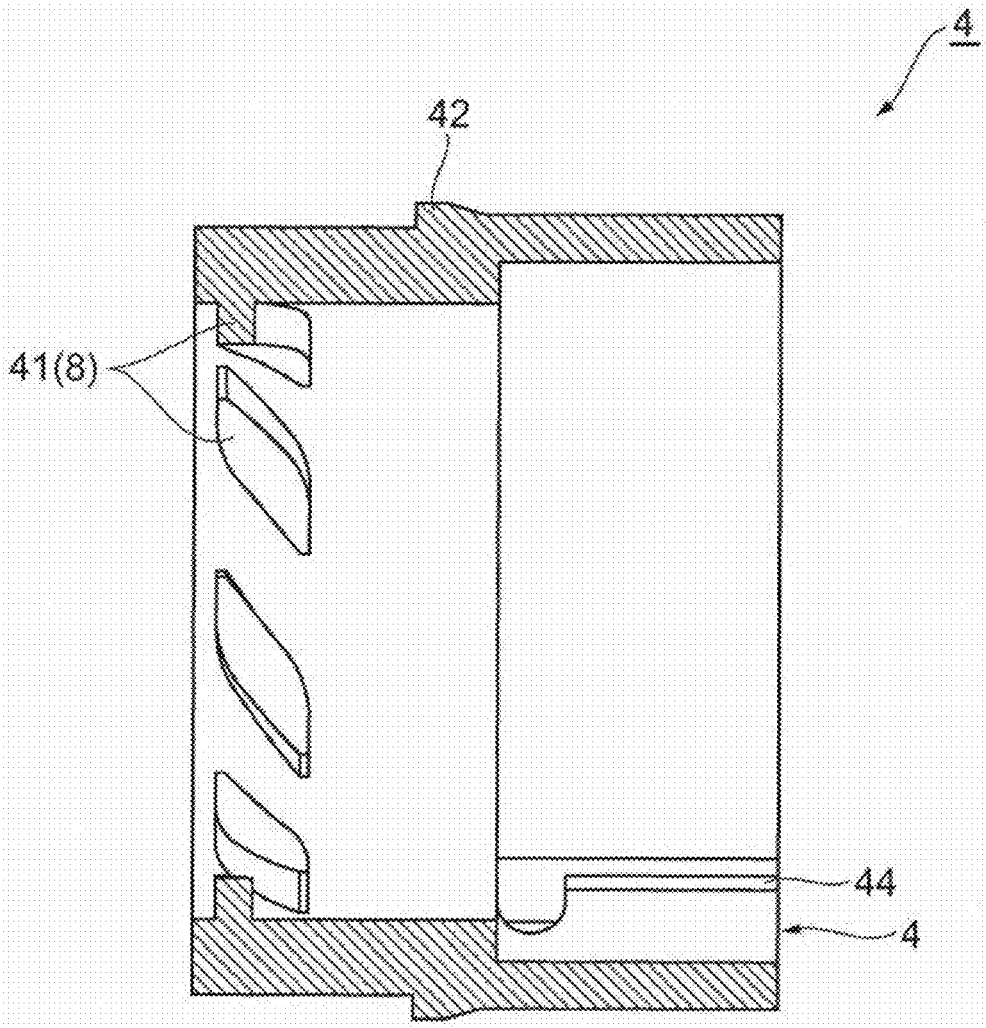
FIG. 10 is a sectional view cut along line X-X in FIG. 9.
Figure 11:
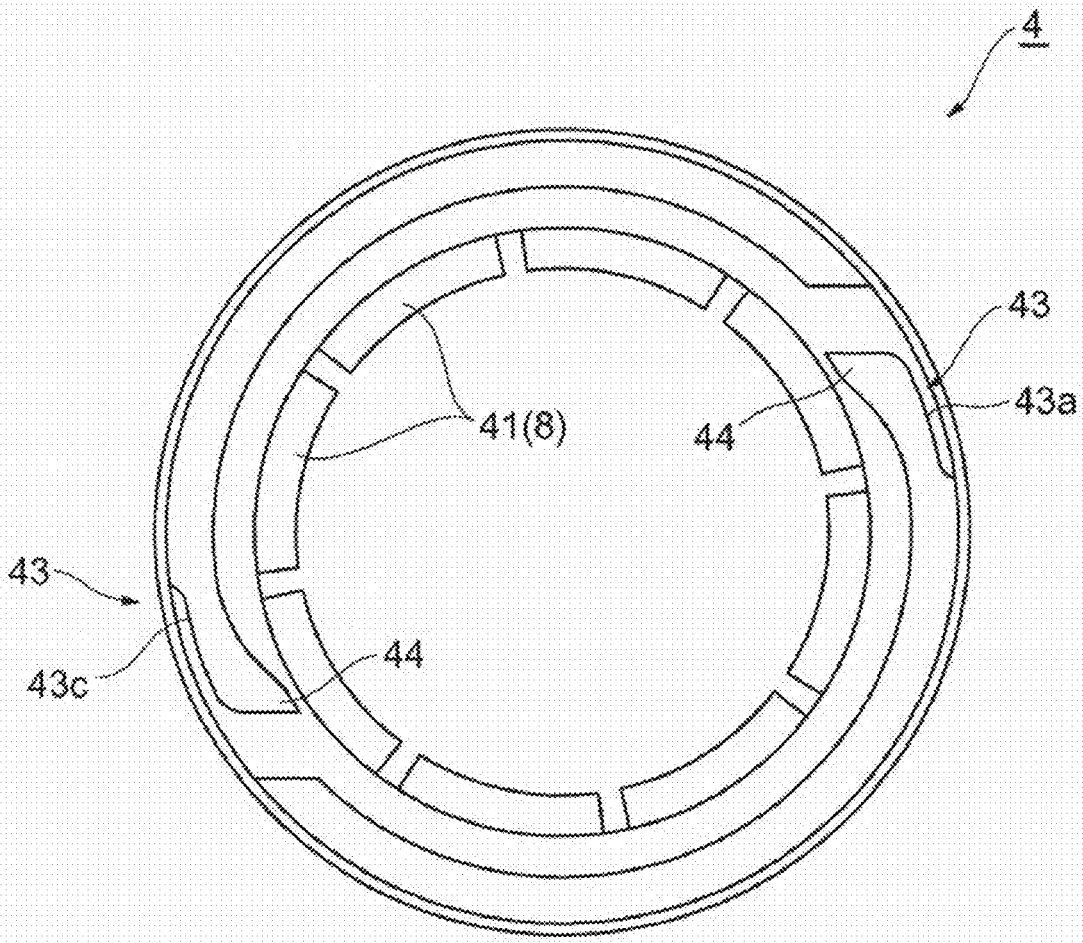
FIG. 11 is a back view illustrating the rotation-stopper tube of the container for pushing out applying material as shown in FIG. 1.
Figure 12:
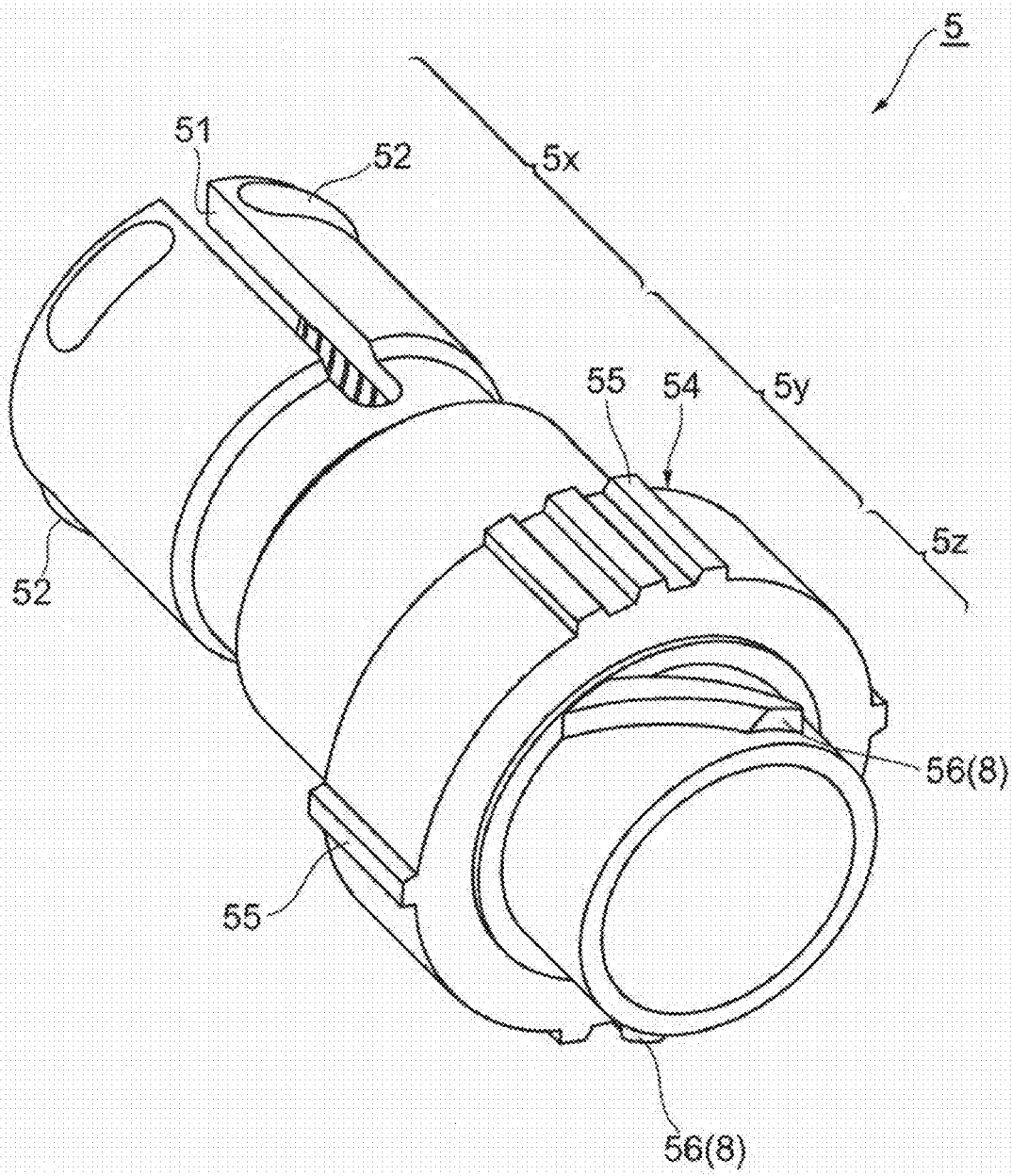
FIG. 12 is a three-dimensional view illustrating the moveable screw tube of the container for pushing out applying material as shown in FIG. 1.
Figure 13:
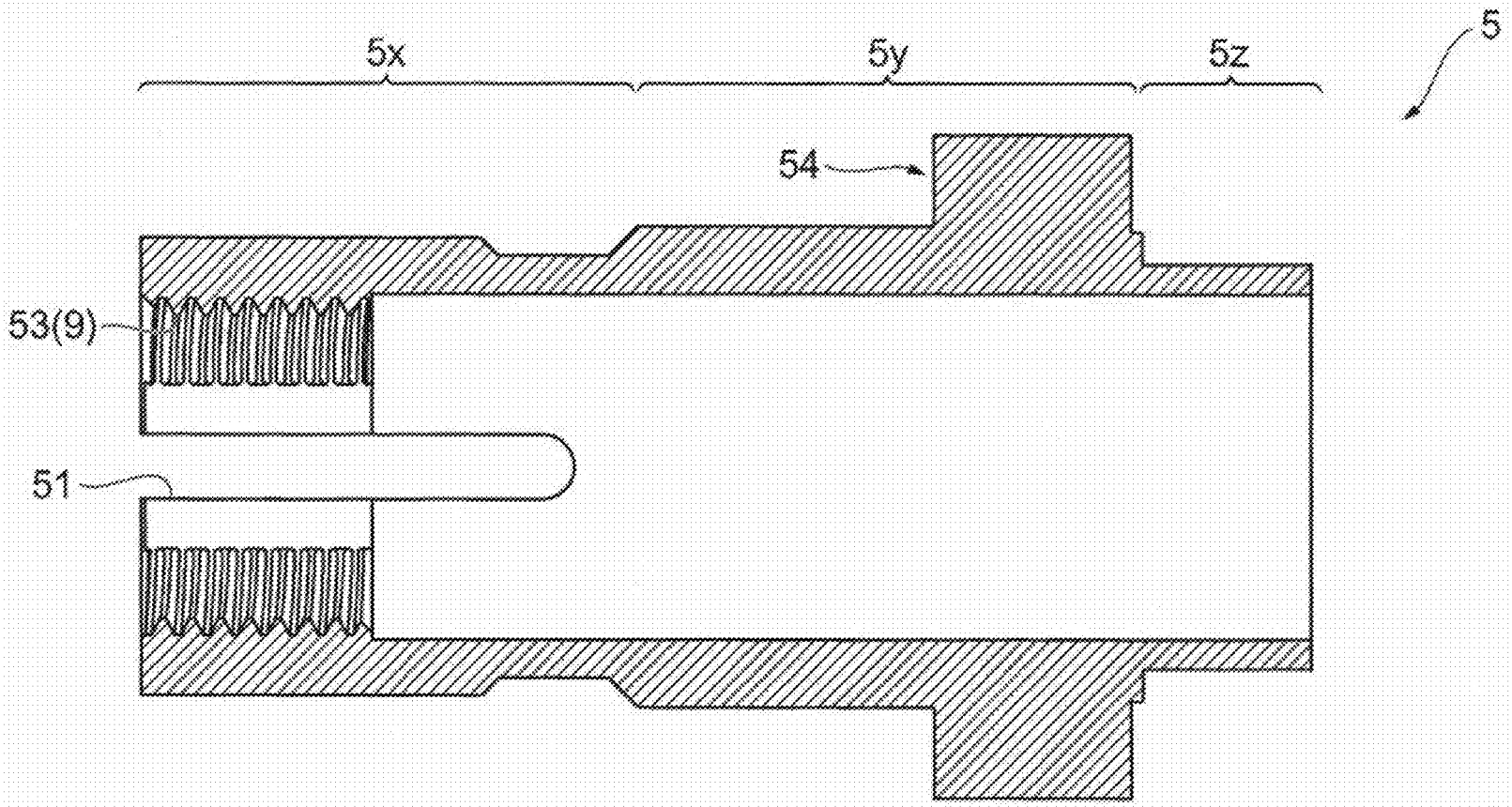
FIG. 13 is a longitudinal sectional view illustrating the moveable screw tube of the container for pushing out applying material as shown in FIG. 1 offset in a position by 90° relative to the longitudinal sectional position as shown in FIG. 1.

FIGS. 1-3 are longitudinal sectional views illustrating the various states of a disclosed container for pushing out applying material according to an example of the present disclosure, FIG. 4 is a longitudinal sectional view illustrating the main body tube, FIGS. 5-7 are views illustrating the main body part of the operation tube, FIGS. 8-11 are views illustrating the rotation-stopper tube, and FIGS. 12-13 are views illustrating the moveable screw tube. As shown in FIG. 1, the container 100 for pushing out applying material accommodates therein the applying material M and pushes out or pulls back the applying material M by proper operation of a user.

Examples of the applying material M may be various rod-like cosmetics, such as lipstick, lip gloss, eyeliner, eye shade, eyebrow pencil, lip liner, blush, concealer, beautifier rod, and hair dye, and rod-like cores for writing stationeries, in particular rods preferably using extremely soft substances (of semisolid shape, soft-solid shape, soft shape, colloidal shape, mousse shape, and paste shape including these shapes).

Moreover, thin rods having an outer diameter of 1 mm or less or thick rods having an outer diameter of 10 mm or more can be used.

The container 100 for pushing out applying material comprises a filling member 1 that is an end tube having a filling region inside to fill the applying material M, a main body tube 2 with its front half part being inserted with the rear half part of the filling member 1 and integrally formed with the filling member 1 both in the axial direction and in the rotation direction, and an operation tube 3 that is connected to the rear end part of the main body tube 2 on the axial direction in a manner of relative rotation, wherein the filling member 1 and the main body tube 2 constitute the front part of the container, and the operation tube 3 constitutes the rear part of the container. Further, the container 100 for pushing out applying material has substantially a rotation-stopper tube 4, a moveable screw tube 5, a moving body 6 and a piston 7 inside. Moreover, the so-called "axis" means a centerline (the same below) extending forwards and backwards along the container 100 for pushing out the applying material.

The rotation-stopper tube 4 is engaged with the main body tube 2 on the axial direction in a manner of relatively rotating with respect to the main body tube 2, and is engaged with the operation tube 3 in a manner of being synchronously rotatable with respect to the operation tube 3 under the action of a rotational force (hereafter referred as "small rotational force") lower than a predetermined rotational force and being relatively rotatable with respect to the operation tube 3 under the action of a rotational force (hereafter referred as "large rotational force") greater than the predetermined rotational force. The moveable screw tube 5 is engaged with the main body tube 2 in a manner of being synchronously rotatable with respect to the main body tube 2 and moveable on the axial direction, and is screwed on the rotation-stopper tube 4 via the first screwing part 8; when the main body tube 2 (or the filling member 1) and the operation tube 3 are relatively rotated toward a first direction, the moveable screw tube 5 advances for a predetermined amount, and when the main body tube 2 and the operation tube 3 are relatively rotated toward a second direction that is opposite to the first direction, the moveable screw tube 5 retreats for a predetermined amount.

The moving body 6 is engaged with the operation tube 3 in a manner of being synchronously rotatable with respect to the operation tube 3 and moveable on the axial direction, and is screwed on the moveable screw tube 5 via the second screwing part 9; when the main body tube 2 and the operation tube 3 are relatively rotated toward a first direction, the moving body 6 separately advances while the moveable screw tube 5 advances; when the moveable screw tube 5 reaches the advance limit and the main body tube 2 and the operation tube 3 are further relatively rotated toward the same direction, the moving body 6 separately advances; when the main body tube 2 and the operation tube 3 are relatively rotated toward a second direction, the moving body 6 separately retreats with the retreating of the moveable screw tube 5; when the moveable screw tube 5 reaches the retreat limit and the main body tube 2 and the operation tube 3 are further relatively rotated toward the same direction, the moving body 6 separately retreats. The piston 7 is mounted at a front end (end) of the moving body 6, so as to form the rear end of the filling region.

As shown in FIG. 4, the main body tube 2 is formed of a cylindrical shape, and embossments 2*a* having a plurality of concave/convex portions extending along the axial direction for a predetermined length are arranged in parallel along a circumferential direction on the inner circumferential surface of the central portion at the axial direction of the main body tube 2. The embossments 2*a* are used to engage the filling member 1 and the moveable screw tube 5 on the rotation direction.

Moreover, an annular concave/convex portion 2*b* (the part of the concave/convex portion arranged on the axial direction) is provided on the inner circumferential surface of the front end part of the main body tube 2, and the annular concave/convex portion 2*b* is used to engage the filling member 1 on the axial direction. Furthermore, a pair of arc-shaped convex portions 2*c* extending on the circumferential direction along the inner circumferential surface is provided opposite each other on the inner circumferential surface of the rear part side of the main body 2 and at the rear side of the embossments 2*a*. The arc-shaped convex portions 2*c* serve to engage the rotation-stopper tube 4 on the axial direction. Moreover, a pair of arc-shaped convex portions 2*d* extending on the circumferential direction along the inner circumferential surface is provided opposite each other on the inner circumferential surface of the main body 2 and at the rear sides of the arc-shaped convex portions 2*c*. The arc-shaped convex portions 2*c* serve to engage the operation tube 3 on the axial direction. When observed from the axial direction, these arc-shaped convex portions 2*c*, 2*d* are arranged discontinuously on the circumferential direction and not overlapping one another.

Referring back to FIG. 1, the operation tube 3 is configured to comprise a main body part 31, and a breechblock part 38 that has a cylindrical shape with a bottom and is mounted on the main body part 31 in a manner of covering the rear part of the main body part 31, capable of synchronously rotating with the main body part 31 but immovable at the axial direction.

As shown in FIGS. 5 and 6, the main body part 31 comprises a tube part 31*x* formed of a cylindrical shape with a bottom, and an axis body 31*y* that is arranged at the bottom center of the tube part 31*x* in a manner of erecting toward the end side.

An annular convex portion 32 is provided at the front part of the outer circumferential surface of the tube part 31*x*, and the annular convex portion 32 engages with the main body tube 2 on the axial direction and abuts against the rear end of the rotation-stopper tube 4. And a circular flange part 33 is provided at the center of the outer circumferential surface of the tube part 31*x*, and the flange part 33 serves to abut against the rear end face of the main body part 2. Moreover, an annular convex portion 34 is provided on the rear end part of the outer circumferential surface of the tube part 31*x* to engage the breechblock part 38 on the axial direction, and a groove part 35 is provided to engage the breechblock part 38 on the rotation direction (see FIG. 6).

The tube part 31*x* has a plurality of protrusions 36 in its outer circumferential surface and at the front side of the annular convex portion 32. The plurality of protrusions 36 are arranged in parallel to one another in a saw-teeth shape on the circumferential direction, and serve to engage the rotation-stopper tube 4. As shown in FIG. 7, sides 36*a* at one side (the side of the protrusions 36 that abut against the convex portions 44 of the rotation-stopper tube 4 when the main body tube 2 and the operation tube 3 are relatively rotated toward the other direction) of the circumferential direction of the plurality of protrusions 36 are inclined in a hill shape with respect to the outer circumferential surface. On the other hand, side 36*b* at the other side (the side of the protrusions 36 that abuts against the convex portions 44 of the rotation-stopper tube 4 when the main body tube 2 and the operation tube 3 are relatively rotated toward a first direction) of the circumferential direction of the plurality of protrusions 36 is inclined in the same direction as the inclining direction of the side 36*a* with respect to the outer circumferential surface, and enters the inner side of the circumferential direction.

As shown in FIG. 5, the axis body 31*y* is structured in a non-circular shape. Specifically, the axis body 31*y* is shaped as a non-circular shape with the cross-section of a protrusive strip 37 on the outer circumferential surface of a cylindrical body. The protrusive strip 37 is disposed in a one-sixth position along the circumferential direction in a manner of protruding toward the outer side of the radius direction, and extends along the axial direction.

As shown in FIG. 1, concerning the operation tube 3 including the main body part 31 and the breechblock part 38, the front side of its main body part 31 is inserted into the main body tube 2, its flange part 33 abuts against the rear end face of the main body tube 2, and the annular convex portion 32 of the main body part 31 engages with the arc-shaped convex portion 2*d* of the main body tube 2 on the axial direction, such that the operation tube 3 is mounted on the main body tube 2 in a manner of being rotatable relative to the main body tube 2 and coupling with the main body tube 2 on the axial direction.

Figure 8:
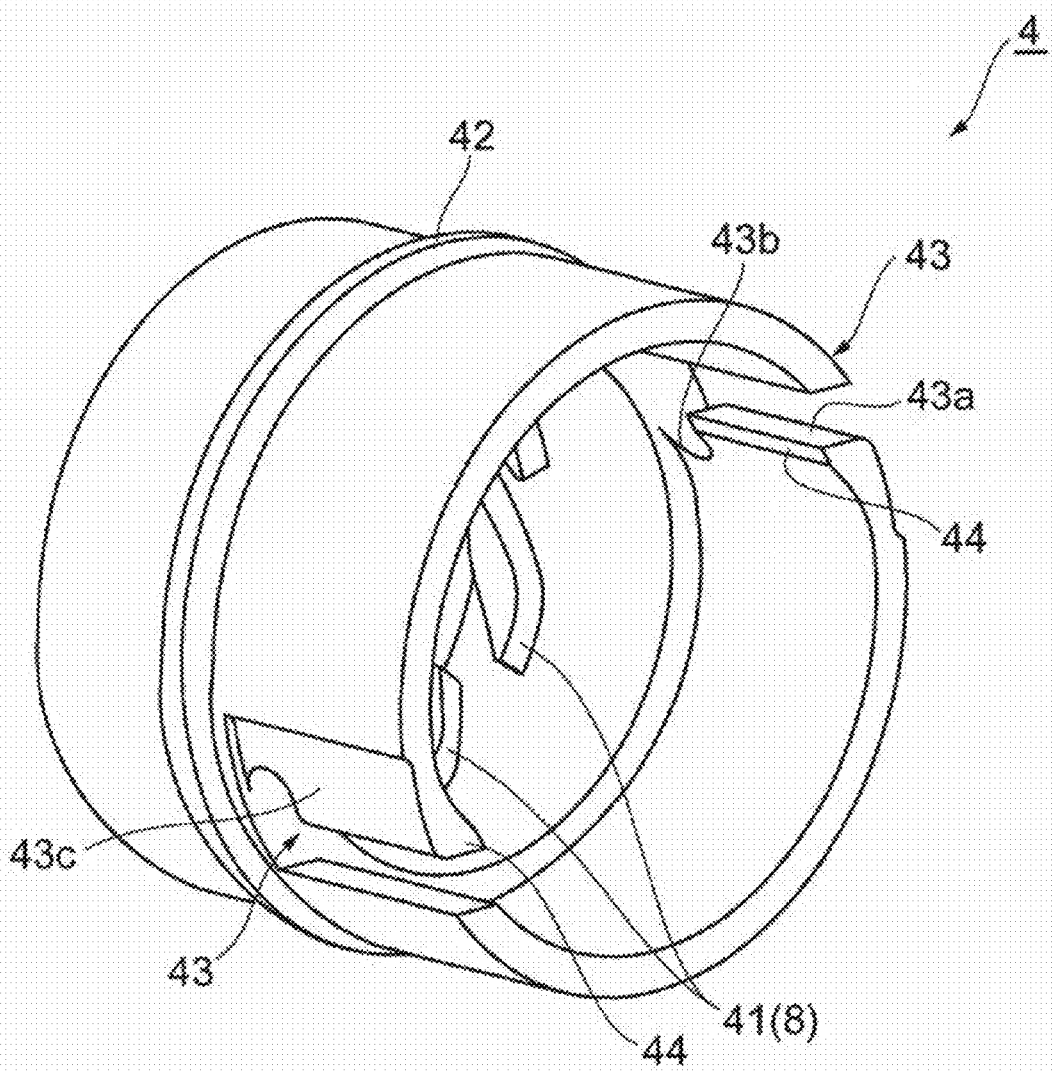
FIG. 8 is a three-dimensional view illustrating the rotation-stopper tube of the container for pushing out applying material as shown in FIG. 1.

As shown in FIGS. 8 and 10, the rotation-stopper tube 4 has a plurality of protrusive strips 41 arranged on the front side of the inner circumferential surface of the rotation-stopper tube 4 and constituting the female thread of the first screwing part 8. These protrusive strips 41 extend spirally along the inner circumferential surface, and end parts of adjacent protrusive strips 41 are staggered and separated from one another at the axial direction. Moreover, the protrusive strips 41 are discontinuously arranged and not overlapping each other as observed from the axial direction (see FIG. 11). An annular convex portion 42 is provided at the center at the axial direction of the outer circumferential surface of the rotation-stopper tube 4 to engage the main body tube 2 on the axial direction.

Figure 9:
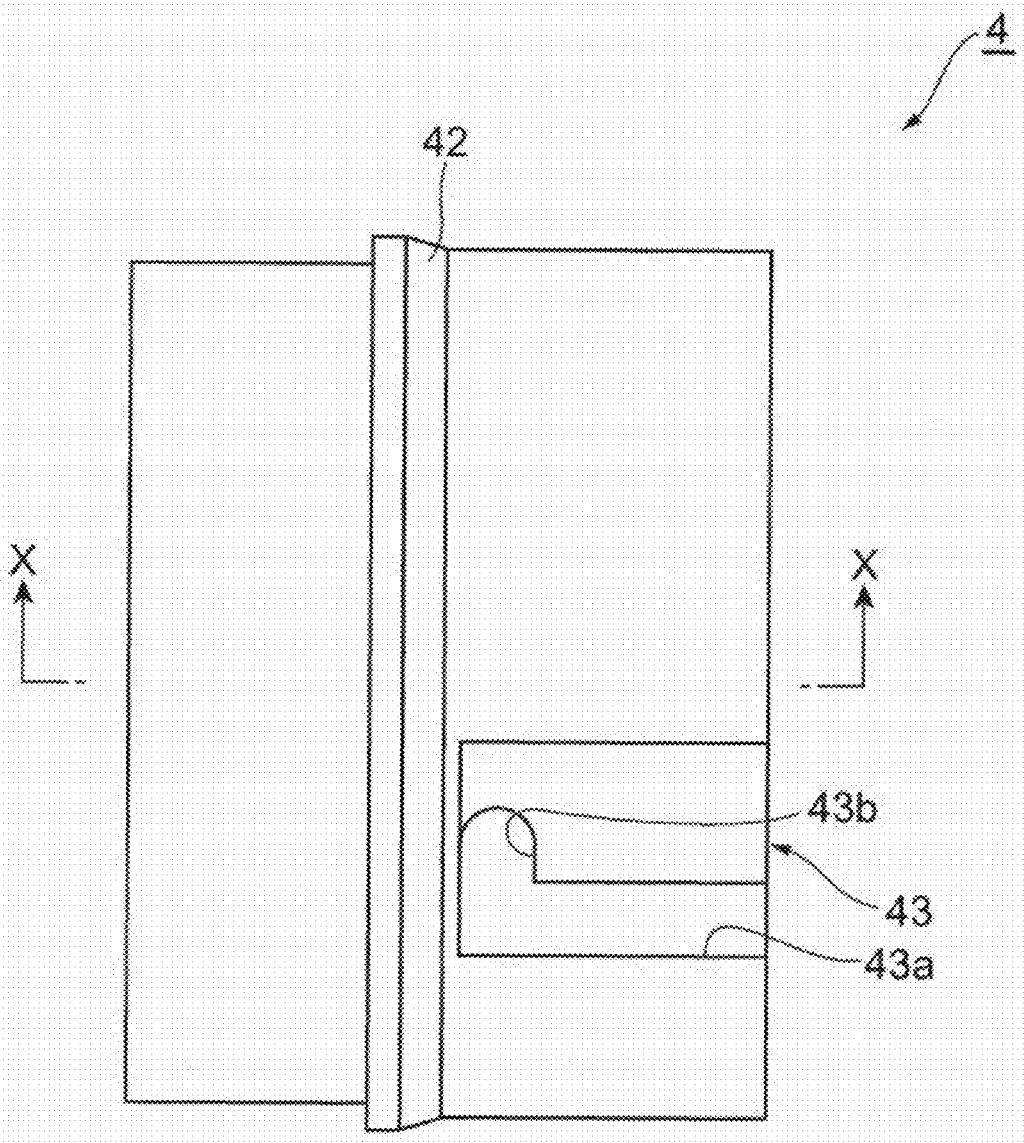
FIG. 9 is a side view illustrating the rotation-stopper tube of the container for pushing out applying material as shown in FIG. 1.

The rotation-stopper tube 4 has an arm part 43 serving to engage the protrusion 36 of the operation tube 3 on the circumferential direction, and a pair of arm parts 43 are provided at opposite positions at the rear side of the annular convex portion 42. The arm parts 43 extend along one direction of the circumferential direction in a manner of having elastic force in the radial direction. Here, as shown in FIG. 9, the arm part 43 is formed by forming slit 43*a* and slit 43*b* on the tube wall of the rotation-stopper tube 4, of which the slit 43*a* extends from the rear end along the axial direction, and the slit 43*b* is continuous with the front end of the slit 43*a* and extends along the radial direction.

As shown in FIGS. 8 and 11, the wall of the arm part 43 has a predetermined thickness, and the arm part 43 is thin-walled at a cutout part 43*c* so that its wall thickness is thinner than the wall thickness of the rotation-stopper tube 4. A convex portion 44 is provided at the radially inner side of the end part of the arm part 43 to abut against the protrusion 36 of the operation tube 3. In the arm part 43, it is possible to set the elastic force of the convex portion 44 as a desired elastic force by properly setting at least one of the shape or length of the slits 43*a*, 43*b*, the wall thickness of the arm part 43, and the protruding height of the convex portion 44. For instance, the elastic force of the convex portion 44 (the arm part 43) can be enhanced by not forming the slits 43*a*, 43*b*.

As shown in FIG. 1, the rotation-stopper tube 4 is internally inserted into the main body tube 2 from its front side or rear side, and its annular convex portion 42 engages the arc-shaped convex portion 2*c* of the main body tube 2 on the axial direction. Moreover, the rear side of the rotation-stopper tube 4 is externally inserted on the main body part 31 of the operation tube 3, and its rear end face abuts against the annular convex portion 32. Thus, the rotation-stopper tube 4 is mounted on the main body tube 2 in a manner of being rotatable relative to the main body tube 2 and engaged with the main body tube 2 on the axial direction.

Moreover, as regards the rotation-stopper tube 4, the convex portion 44 of its arm part 43 exerts force radially inside the protrusion 36 of the operation tube 3 and abuts against the protrusion 36, and is engaged at the rotation direction (circumferential direction) by means of the force generated by the convex portion 44 of the arm part 43, and a predetermined engaging force generated by frictional force between the shape of the convex portion 44, the sides 36*a*, 36*b* (see FIG. 7) and the convex portion 44. Accordingly, synchronous rotation is possible in the case when the operation tube 3 and the rotation-stopper tube 4 are relatively rotated toward a first direction, and in the case when the operation tube 3 and the rotation-stopper tube 4 are relatively rotated toward a second direction, synchronous rotation is possible when the small rotational force is applied thereon, and relative rotation is possible when the large rotational force is applied thereon (see following explanations for details).

In addition, a spacing S1 is set between the inner circumferential surface of the main body tube 2 and the outer circumferential surface of the rotation-stopper tube 4, thus allowing radial bending of the arm part 43.

As shown in FIG. 12, a pair of slits 51 extending from the front end along the axial direction for a predetermined length are formed in a manner opposite each other at the front end part (end side) 5*x* of the moveable screw tube 5. Thus, the front end part 5*x* is configured to radially outwardly expand. A plurality (four in this case) of convex portions 52 are provided close to the positions of the slits 51 in the front side of the outer circumferential surface of the front end part 5*x*. Thus, the outer diameter of the front end part 5*x* can be properly adjusted by adjusting the protruding height of the convex portions 52.

Moreover, as shown in FIG. 13, a female thread 53 of the second screwing part 9 is provided within the range from the front end until a predetermined length of the rear end in the inner circumferential surface of the front end part 5*x*. Additionally, the screw pitch of the second screwing part 9 is shorter than the screw pitch of the first screwing part 8, and the lead (the pushing amount per cycle of the relative rotation of the main body tube 2 and the operation tube 3) of the first screwing part 8 is set to be larger than the lead of the second screwing part 9.

Moreover, a circular flange part 54 is provided at the rear side in the outer circumferential surface of the central part 5*y* of the moveable screw tube 5. As shown in FIG. 12, a plurality of protrusive strips 55 extending along the axial direction are provided on the outer circumferential surface of the flange part 54 to engage the embossments 2*a* of the main body tube 2.

Furthermore, a pair of protrusive strips 56 are provided in a manner opposite each other on the outer circumferential surface of the rear end part 5*z* of the moveable screw tube 5, and these protrusive strips 56 serve as the male thread constituting the first screwing part 8. These protrusive strips 56 extend spirally along the outer circumferential surface and discontinuously arranged in a manner not overlapping each other as observed from the axial direction.

As shown in FIG. 1, the moveable screw tube 5 is internally inserted into the main body tube 2, and its protrusive strips 55 engage the embossments 2*a* of the main body tube 2, so as to be assembled in a manner of engaging on the rotation direction relative to the main body tube 2 and moveable on the axial direction. In addition, the moveable screw tube 5 is externally inserted on the axis body 31*y* of the operation tube 3, and the protrusive strips 56 at its rear end part 5*z* are screwed with the protrusive strips 41 of the rotation-stopper tube 4.

The moving body 6 is configured to have a cylindrical shape of a flange part 6*a* at a front end side thereof, and have a male thread 6*b* of the second screwing part 9 on the outer circumferential surface from the rear side of the flange part 6*a* till the rear end part. A protruding strip 6*c* protruding radially and extending along the axial direction is arranged at a one-sixth position along the circumferential direction in the inner circumferential surface of the moving body 6, and this protruding strip 6*c* serves to engage the operation tube 3 on a direction rotating around the axis.

Further, the moving body 6 is externally inserted at its rear end side between the axis body 31*y* of the operation tube 3 and the moveable screw tube 5. At this time, as regards the moving body 6, its male thread 6*b* is screwed with the female thread 53 of the moveable screw tube 5, and its protrusive strip 6*c* enters between the protrusive strips 37, 37 of the axis body 31*y* so as to engaged therewith on the rotation direction, and is thereby mounted on the operation tube 3 in a manner of synchronously rotatable with the operation tube 3 and moveable at the axial direction.

The piston 7 is shaped by using such a relatively soft material such as PP (polypropylene), HDPE (high density polyethylene), or LLDPE (linear low density polyethylene). The piston 7 is of a bell shape tapering towards the front end, and an annular convex portion 7*b* capable of moving for a predetermined length on the axial direction relative to the moving body 6 to engage the moving body 6 is provided on the inner circumferential surface of a concave portion 7*a* disposed at the rear end face.

The piston 7 is externally inserted on the moving body 6, and its annular convex portion 7*b* engages the moving body 6 on the axial direction, so as to be mounted on the moving body 6 in a manner of being rotatable relative to the moving body 6 and movable (within a predetermined range) on the axial direction.

The filling member 1 is used for filling the applying material M in a filling region therein, and for expelling the applying material M from the front end part according to operation of a user. The filling member 1 is of a cylindrical shape, and the opening 1*a* at its end forms an opening for the applying material M to appear. The opening 1*a* is formed of an inclined angle face inclined by a predetermined degree relative to the axial direction. In other words, the filling member 1 is formed with its end face inclined relative to the axial direction. Additionally, the opening 1*a* is sometimes formed of a plane shape formed by a vertical plane of the axial direction or of a hill shape, as it is possible to select various shapes according to the methods of applying the applying material.

Moreover, an annular convex/concave portion 1*b* that engages the annular concave/convex portion 2*b* of the main body tube 2 on the axial direction is provided on the outer circumferential surface of the filling member 1, and protrusive strips 1*g* extending along the axial direction are provided at a one-fourth positions on the circumferential direction in the outer circumferential surface of the filling member 1 closer to the rear side than the annular convex/concave portion 1*b*. These protrusive strips 1*g* engage the embossments 2*a* of the main body tube 2 on the rotation direction.

The inner circumferential surface 11 of the filling member 1 restricts the outer diameter of the front end part 5*x* (to be described in greater detail later) to prevent the front end part 5*x* in the moveable screw tube 5 from expanding, and the inner diameter of the inner circumferential surface 11 here is slightly larger than the outer diameter of the front end part 5*x*. Moreover, a diameter expanding part 12 is provided in a region from the rear end till a predetermined length of front side in the inner circumferential surface 11 of the filling member 1, and the diameter expanding part 12 serves to properly restrict the outer diameter of the front end part 5*x* and release the restriction. Thus, the rear end part of the filling member 1 is configured to have its wall thickness become thinner. The wall surface at the front side of the diameter expanding part 12 is inclined smoothly and continuously with the inner circumferential surface 11.

As shown in FIG. 1, the filling member 1 is inserted from its rear side between the main body tube 2 and the moveable screw tube 5, the annular concave/convex portion 2*b* of the main body tube 2 engages the annular convex/concave portion 1*b* on the axial direction, and the embossments 2*a* of the main body tube 2 engage the protrusive strips 1*g* on the rotation direction, so that the filling member 1 is mounted on the main body tube 2 by engaging the main body tube 2 on the axial direction and the rotation direction, and integrated with the main body tube 2.

Moreover, the piston 7 is inserted closely into the rear end part of the filling member 1, and a cap 13 serving as a protective member is detachably mounted on the filling member 1. Furthermore, inside the main body tube 2, a helical spring 14 having a predetermined elastic force is coaxially interposed between the rear end face of the filling member 1 and the flange part 54 of the moveable screw tube 5, and exerts force on the moveable screw tube 5 toward the rear of the axial direction. Thus, when the moveable screw tube 5 advances for a predetermined amount so that the screw function of the first screwing part 8 is released, force is applied to the moveable screw part 5 to restore the screw of the first screwing part 8.

The helical spring 14 is for instance formed of a resin spring fabricated by using such a resin as POM (polyoxymethylene) or PP (polypropylene) to injection-mold a part of a cut cylindrical shape, or of a spring fabricated by forming a stainless steel wire material into a helical shape.

As regards the initial state of the container 100 for pushing out applying material as shown in FIG. 1 having the aforementioned structure, the applying material M filled in the filling region is in a state of being closely filled with the inner circumferential surface 11 of the filling member 1 and the piston 7. Thus, the applying material M is pushed out from the opening 1*a* of the filling member 1 by advancing the piston 7 closely fitted inside the filling member 1. On the other hand, the piston 7 closely fitted inside the filling member 1 retreats and an attraction force is generated inside the filling member 1 due to decompression action, so that the applying material M is pulled back into the filling member 1.

That is to say, firstly, when a user takes the cap 13 off and relatively rotates the main body tube 2 and the operation tube 3 toward the outward direction, namely the a first direction, the convex portion 44 of the arm part 43 of the rotation-stopper tube 4 is engaged (fixedly engaged) on the side 36*b* (see FIG. 7) of the protrusions 36 of the operation tube 3 on the rotation direction with a predetermined engaging force, the moveable screw tube 5 relatively rotates with the operation tube 3 and the rotation-stopper tube 4 due to the synchronous rotation of the operation tube 3 and the rotation-stopper tube 4, the first screwing part 8 formed of the protrusive strip 56 of the moveable screw tube 5 and the protrusive strip 41 of the rotation-stopper tube 4 exerts screw function, and operates in synergy with a rotation-stopper part formed of the protrusive strip 55 of the moveable screw tube 5 and the embossment 1*g* of the filling member 1, to thereby urge the moveable screw tube 5 forward. Moreover, the predetermined engaging force between the convex portion 44 and the protrusion 36 during relative rotation toward the first direction is hereinafter referred to as the "engaging force of the first direction".

At the same time, the filling member 1 is relatively rotated with the moveable screw tube 5 and the moving body 6, the second screwing part 9 formed of the female thread 53 of the moveable screw tube 5 and the male thread 6*b* of the moving body 6 exerts screw function, and operates in synergy with a rotation-stopper part formed of the protrusive strip 37 of the axis body 31*y* in the operation tube 3 and the protrusive strip 6*c* of the moving body 6, so that the moving body 6 also advances. That is to say, the moving body 6 also separately advances with the advancement of the moveable screw tube 5.

Further, as shown in FIG. 2, when relative rotation is further carried out toward the first direction and the moveable screw part 5 advances for a predetermined amount, the front end part 5*x* (see FIG. 1) of the moveable screw tube 5 located inside the diameter expanding part 12 of the filling member 1 is located in the inner circumferential surface 11 of the filling member 1. Thus, the inner circumferential surface 11 of the filling member 1 is made use of to restrict the outer diameter of the front end part 5*x* to prevent the front end part 5*x* from expanding.

Moreover, if relative rotation is continued toward the first direction, the moving body 6 advances and the protrusive strip 56 of the moveable screw tube 5 is detached from the front end of the protrusive strip 41 of the rotation-stopper tube 4, the screw function of the first screwing part 8 is released, and the moveable screw tube 5 reaches the advance limit. In the state where the moveable screw tube 5 is in the advance limit, the moveable screw tube 5 is applied with force toward the rear side thereof due to reduced elastic force of the helical spring 14, so that, when the main body tube 2 and the operation tube 3 are relatively rotated toward the return direction, namely the other direction, the protrusive strip 56 of the moveable screw tube 5 directly enters the adjacent end in the protrusive strip 41 of the rotation-stopper tube 4 on the rotation direction, and the first screwing part 8 directly restores screw.

Subsequently, if relative rotation is further continued toward the first direction, the first screwing part 8 is applied with force by the helical spring 14 in a manner of restoring screw and only the second screwing part 9 exerts the screw function, and the moving body 6 further advances. Thus, as shown in FIG. 3, the protrusive strip 6*c* of the moving body 6 is detached from the end of the protrusive strip 37 of the axis body 31*y* in the operation tube 3 so that the rotation-stopper part does not function any more, and the moving body 6 reaches the advance limit.

In the state where the moving body 6 is in the advance limit, although the protrusive strip 6*c* of the moving body 6 is detached from the protrusive strip 37 of the operation tube 3, the second screwing part 9 still screws, so that the moving body 6 is pulled back through the second screwing part 9 and the moveable screw tube 5 by means of the helical spring 14. Consequently, in the state of the advance limit, when the main body tube 2 and the operation tube 3 are relatively rotated toward a second direction, the protrusive strips 6*c*, 37 directly engage with each other so that the rotation-stopper part does not function, and the moving body 6 directly retreats.

On the other hand, for instance after use, when the main body tube 2 and the operation tube 3 are relatively rotated toward the second direction, the small rotational force is applied to the operation tube 3 and the rotation-stopper tube 4, the convex portion 44 of the arm part 43 of the rotation-stopper tube 4 is engaged on the sides 36*a* (see FIG. 7) of the protrusions 36 of the operation tube 3 on the circumferential direction with a predetermined engaging force, and the operation tube 3 and the rotation-stopper tube 4 are synchronously rotated, so that the moving screw tube 5 is relatively rotated with the operation tube 3 and the rotation-stopper tube 4, and the first screwing part 8 exerts screw function and hence the moveable screw tube 5 retreats. Additionally, the predetermined engaging force between the convex portion 44 and the protrusion 36 during relative rotation toward the second direction is hereinafter referred to as the "engaging force of the second direction".

At the same time, the filling member 1 is relatively rotated with the moveable screw tube 5 and the moving body 6, and the second screwing part 9 exerts screw function and hence the moving body 6 also retreats. That is to say, the moving body 6 also separately retreats with the retreating of the moveable screw tube 5.

Further, when relative rotation is continued toward the second direction so that the moveable screw tube 5 retreats for a predetermined amount, the front end part 5*x* of the moveable screw tube 5 located inside the inner circumferential surface 11 of the filling member 1 is located in the diameter expanding part 12 of the filling member 1, and thus restriction to the outer diameter of the front end part 5*x* is released and the front end part 5*x* is hence in an expandable state.

Moreover, when relative rotation is continued toward the second direction, the flange part 54 of the moveable screw tube 5 abuts against the front end face of the rotation-stopper tube 4, the first screwing part 8 stops screw function, the moveable screw tube 5 and the rotation-stopper tube 4 are in the state of synchronous rotation by means of an axial force generated by the first screwing part 8, for instance, and the moveable screw tube 5 reaches the retreat limit (see FIG. 1). Thus, when the first screwing part 8 stops screw function, and the moveable screw tube 5 and the rotation-stopper tube 4 are capable of being synchronously rotated, even if the small rotational force is thereafter applied to the operation tube 3 and the rotation-stopper tube 4, they will not be relatively rotated. Therefore, after the screw function of the first screwing part 8 is stopped, even if it is intended to relatively rotate the main body tube 2 and the operation tube 3 toward the second direction by the same operational rotational force (the rotational force applied by an operator; the same below) as that before the screw function is stopped, the main body tube 2 and the operation tube 3 will not be relatively rotated.

However, although the screw function of the first screwing part 8 is stopped, if the user does not stop the relative rotation of the main body tube 2 and the operation tube 3 but applies thereto an operational rotational force greater than the operational rotational force before the screw function is stopped, the main body tube 2 and the operation tube 3 are further relatively rotated toward the second direction, and the large rotational force is applied to the operation tube 3 and the rotation-stopper tube 4, the operation tube 3 and the rotation-stopper tube 4 will be rotated under a rotational force greater than the engaging force of the second direction, so that the convex portion 44 of the arm part 43 slides and passes over the protrusions 36 in a manner of climbing up the sides 36*a* of the protrusions 36, and the operation tube 3 and the rotation-stopper tube 4 are relatively rotated (hereinafter referred to as "idle rotation"). Thus, the filling member 1 and the moveable screw tube 5 are relatively rotated with the rotation-stopper tube 4, the moving body 6 and the operation tube 3, only the second screwing part 9 exerts screw function in the state where the screw function of the first screwing part 8 is stopped, and the moving body 6 further retreats.

Accordingly, if relative rotation is continued toward the second direction with the operational rotational force greater than that before the screw function is stopped, the rear end of the moving body 6 reaches the bottom surface of the main body part 31 of the operation tube 3, and the moving body 6 reaches the retreat limit. In the state that the moving body 6 is in the retreat limit, the restriction to the outer diameter of the front end part 5*x* of the moveable screw tube 5 is released as previously mentioned, so that even if relative rotation is thereafter carried out toward the second direction and a greater rotational force is applied to the second screwing part 9, the front end part 5*x* expands and the screw function of the second screwing part 9 is hence released.

Additionally, during such abnormalities as the first screwing part 8 is deformed so as to be inoperative, if the main body tube 2 and the operation tube 3 are relatively rotated toward the first direction, and the rotation-stopper tube 4 and the operation tube 3 are applied with a rotational force greater than the engaging force of the first direction, the engagement between the convex portion 44 of the arm part 43 and the operation tube 3 is released, the operation tube 3 and the rotation-stopper tube 4 are idly rotated, the filling member 1 and the moveable screw tube 5 are relatively rotated with the rotation-stopper tube 4, the moving body 6 and the operation tube 3, and only the second screwing part 9 exerts the screw function to urge the moving body 6 forward. Accordingly, since the second screwing part 9 exerts the screw function and the moving body 6 can hence advance and retreat even during abnormalities, it is also possible to push out or pull back the applying material M and to properly use the container 100 for pushing out applying material.

As mentioned above, in the container 100 for pushing out applying material according to this example, the front end part 5*x* of the female thread 53 of the second screwing part 9 disposed inside the moving screw tube 5 can radially outwardly expand via the slit 51. Therefore, under the circumstance that the female thread 53 of the moveable screw tube 5 is formed by using the core pin for instance, the core pin can be pulled (the so-called pulling perforce) on the axial direction without having to pull out the core pin through rotation. Moreover, under the circumstance that the moving body 6 is assembled on the moveable screw tube 5 for instance, it is unnecessary to assemble the moving body 6 on the moveable screw tube 5 while rotating due to the second screwing part 9, as it is possible to insert the moving body 6 into the moveable screw part 5 on the axial direction for assembly all in one operation. Therefore, fabrication of the container 100 for pushing out applying material is made easy.

Moreover, as mentioned above, when the main body tube 2 and the operation tube 3 are relatively rotated toward the first direction, and the moveable screw tube 5 advances for a predetermined amount, the outer diameter of the front end part 5*x* of the moveable screw tube 5 is restricted so that the expansion thereof is prevented. Consequently, when relative rotation is further carried out toward the first direction and the moving body 6 advances by virtue of the screw function of the second screwing part 9, the circumstance is suppressed in which the front end part 5*x* of the moveable screw tube 5 expands so that the inner diameter of the female thread 53 is enlarged due to the sliding resistance between the applying material M and the inner circumferential surface 11 of the filling member 1. That is to say, the second screwing part 9 reliably exerts the screw function when the moving body 6 advances, thus making use of sufficient pushing strength to push out the applying material M. In other words, this example makes the fabrication easy and fully ensures the pushing strength of the applying material M.

Moreover, in this example as previously mentioned, when the main body tube 2 and the operation tube 3 are relatively rotated toward the second direction, the moveable screw tube 5 retreats for a predetermined amount under the screw function of the first screwing part 8, so that restriction to the outer diameter of the front end part 5*x* of the moveable screw tube 5 is released. Consequently, when the moving body 6 is in the retreat limit, even if the main body tube 2 and the operation tube 3 are further relatively rotated toward the second direction so as to apply the large rotational force on the second screwing part 9, it is still possible to suppress damage to the second screwing part 9 and its peripheral parts because the front end part 5*x* expands and the screw function of the second screwing part 9 is hence released.

Furthermore, in this example as previously mentioned, even if the main body tube 2 and the operation tube 3 are further relatively rotated toward the second direction in the state that the screw function of the first screwing part 8 is stopped, since the operation tube 3 and the rotation-stopper tube are idly rotated and therefore only the second screwing part 9 exerts the screwing function, no excessive rotational force is applied to the first screwing part 8, and the moving body 6 retreats, so that it is possible to suppress damage to the first screwing part 8 and its peripheral parts.

Still, in this example, in the state that the screw function of the first screwing part 8 is stopped, when the main body tube 2 and the operation tube 3 are relatively rotated toward the second direction, the screw function of the first screwing part 8 directly resumes (functions again) independent of such force-applying unit as a spring. Consequently, it is possible to suppress such adverse effect as caused by the strength or weakness or timing variations of the force-applying unit, and possible to reliably restore the screw function of the first screwing part 8.

Moreover, in this example as previously mentioned, the convex portion 44 of the arm part 43 of the rotation-stopper tube 4 engages the protrusion 36 of the operation tube 3 on the rotation direction with a predetermined engaging force, and when the main body tube 2 and the operation tube 3 are relatively rotated so as to apply a rotational force on the operation tube 3 and the rotation-stopper tube 4, the operation tube 3 and the rotation-stopper tube 4 are relatively/synchronously rotated according to the magnitude of the rotational force and the predetermined engaging force. Accordingly, by properly setting the elastic force possessed by the convex portion 44 of the arm part 43 and the shape of the protrusion to control the predetermined engaging force, it is possible to control the relative rotation of the operation tube 3 and the rotation-stopper tube 4 for them to be relatively rotated in a desired manner.

Furthermore, in this example as previously mentioned, when the main body tube 2 and the operation tube 3 are relatively rotated toward the first direction and the moveable screw tube 5 reaches the advance limit, although the thread teeth of the first screwing part 8 detach from one another and do not engage, since the moveable screw tube 5 is applied with force toward the direction where screw is restored via the action force of the helical spring 14, when relative rotation is continued toward the first direction so that the moving body 6 advances merely through the action of the second screwing part 9, a sense of click will be generated, and pushing out of the applying material M can hence be perceived.

Moreover, in this example as previously mentioned, when the main body tube 2 and the operation tube 3 are relatively rotated toward the second direction and the moveable screw tube 5 reaches the retreat limit, the screw function of the first screwing part 8 is stopped; when relative rotation is continued toward the second direction, the convex portion 44 of the arm part 43 of the rotation-stopper tube 4 passes over the protrusion 36 of the operation tube 3, and the rotation-stopper tube 4 and the operation tube 3 are relatively rotated. Since a sense of click is generated when the convex portion 44 passes over the protrusion 36, retreating of the piston 7 and the moving body 6 can be perceived.

Furthermore, in this example as previously mentioned, since the lead of the first screwing part 8 is set to be larger than the lead of the second screwing part 9, the following effect can be achieved. That is to say, when the main body tube 2 and the operation tube 3 are relatively rotated toward the first direction, the applying material M is firstly quickly pushed out till use thereof, and the applying material M is then slowly pushed out, so that excessive exposure of the applying material M can be prevented. Moreover, when relative rotation is carried out toward the second direction, the applying material M firstly quickly retreats for a predetermined amount and then slowly retreats, so that excessive retraction of the applying material M can be prevented.

Additionally, the method of filling the applying material M into the filling member 1 can be to fill the molten applying material M from the end side of the filling member 1, and can also be to fill the applying material M from the rear end side of the filling member 1 and then to assemble the filling member 1. Moreover, under the circumstance the applying material M is a rod-like substance shaped by a mold or by means of extrusion, it is also possible to fill the applying material M after being assembled.

Moreover, by using the rotation-stopper tube 4 according to this example, the predetermined amount for which the moving body 6 and the moveable screw part 5 advance (or retreat) by the action of the first screwing part 8 can be set as a fine lead of approximately 1 to 2 mm or less. Thus, in the advancement (or retreating) merely by the action of the second screwing part 9 after the predetermined amount of advancement (or retreating), the moving body 6 can slowly advance (or retreat) with a lead of approximately 0.5 mm, and the applying material M will not deform even if it is extremely soft so that the applying material M can be continuously used.

Figure 14:
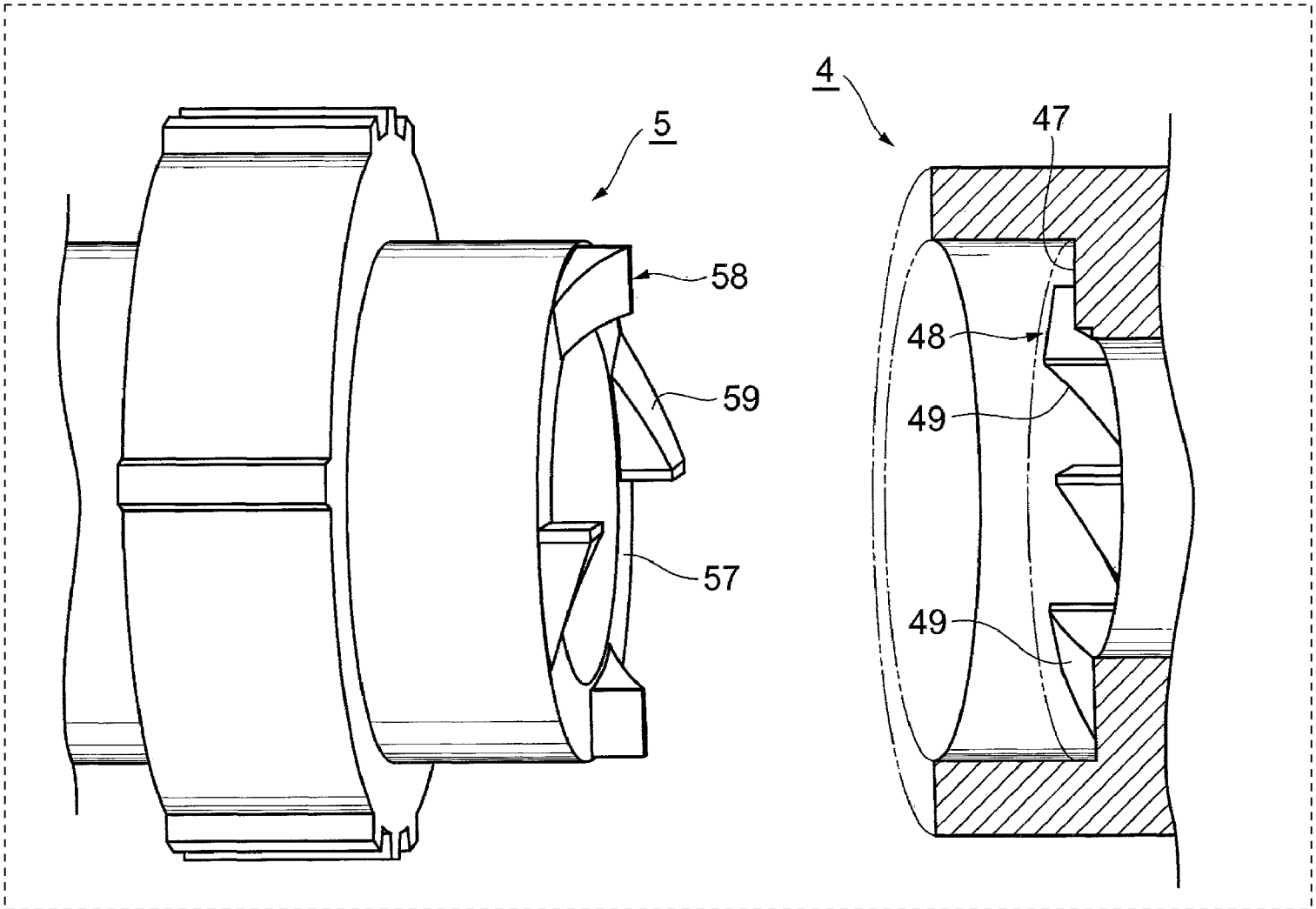
FIG. 14 is a view illustrating other examples of the rotation-stopper tube and the moveable screw tube of the container for pushing out applying material as shown in FIG. 1.

Furthermore, in this example, when the main body tube 2 and the rotation-stopper tube 4 are relatively rotated, the moveable screw tube 5 advances/retreats for a predetermined amount by the screw function of the first screwing part 8, but it suffices for the moveable screw tube 5 to advance for a predetermined amount, as it is possible to replace the first screwing part 8 with various such devices as the ratchet mechanism shown in FIG. 14. Still, it suffices for the moveable screw tube 5 to advance for a predetermined amount, and it is also possible to configure the moveable screw tube 5 as incapable of retreating.

In the other examples of the rotation-stopper tube 4 and the moveable screw tube 5 as shown in FIG. 14, the rotation-stopper tube 4 is formed by replacing the female thread 41 of the first screwing part 8 with a convex portion 48, and the moveable screw tube 5 is formed by replacing the male thread 56 of the first screwing part 8 with a convex portion 58. The convex portion 48 is arranged in parallel along the circumferential direction on an end face 47 of the front end side of the rotation-stopper tube 4, and is of a hill shape inclining toward one side of the circumferential direction. The convex portion 58 is arranged in parallel along the circumferential direction on an end face 57 of the rear end side of the moveable screw tube 5, and is of a hill shape inclining toward the second side of the circumferential direction. The rotation-stopper tube 4 and the moveable screw tube 5 are engaged with each other to be assembled in such a manner that the convex portions 48, 58 abut against slanting faces 49, 59, and when they are relatively rotated toward the first direction, the moveable screw tube 5 advances via the slanting faces 49, 59; on the other hand, when they are relatively rotated toward the second direction, the moveable screw tube 5 retreats for a predetermined amount via the slanting faces 49, 59 and the action force of the helical spring 14.

The present disclosure is not restricted to the above examples.

For instance, in the aforementioned examples, since the inner diameter of the inner circumferential surface 11 of the filling member 1 is slightly larger than the outer diameter of the front end part 5*x* of the moveable screw tube 5, the outer diameter of the front end part 5*x* is restricted in a non-contacting manner, but it is also possible to restrict the outer diameter of the front end part 5*x* in a sliding-contact manner.

Moreover, in the aforementioned examples, the protrusive strip 56 serving as the male thread of the first screwing part 8 is disposed on the outer circumferential surface of the moveable screw tube 5, and the protrusive strip 41 serving as the female thread is disposed on the inner circumferential surface of the rotation-stopper tube 4, but it is also possible to dispose the male thread of the first screwing part 8 on the inner circumferential surface of the moveable screw tube 5, and to dispose the female thread on the outer circumferential surface of the rotation-stopper tube 4.

Furthermore, in the above examples, after the moveable screw tube 5 advances for a predetermined amount under the screw function of the first screwing part 8, the screw function of the first screwing part 8 is released, but it is also possible to stop the screw function of the first screwing part 8, in which case when relative rotation is further carried out toward the first direction, only the second screwing part 9 exerts the screw function to urge the moving body 6 forward in the state when the screw function of the first screwing part 8 is stopped. Still, under such a circumference or in the aforementioned examples, it is also possible that after the moveable screw part 5 retreats for a predetermined amount under the screw function of the first screwing part 8, the screw function of the first screwing part 8 is released, so that, when relative rotation is further carried out toward the second direction, only the second screwing part 9 exerts the screw function to urge the moving body 6 backward.

Additionally, it is also possible that after the main body tube 2 and the operation tube 3 are relatively rotated toward the second direction and the first screwing part 8 exerts the screw function to urge the moveable screw tube 5 backward for a predetermined amount, the screw functions of both of the first screwing part 8 and the second screwing part 9 are stopped.

Figure 15:
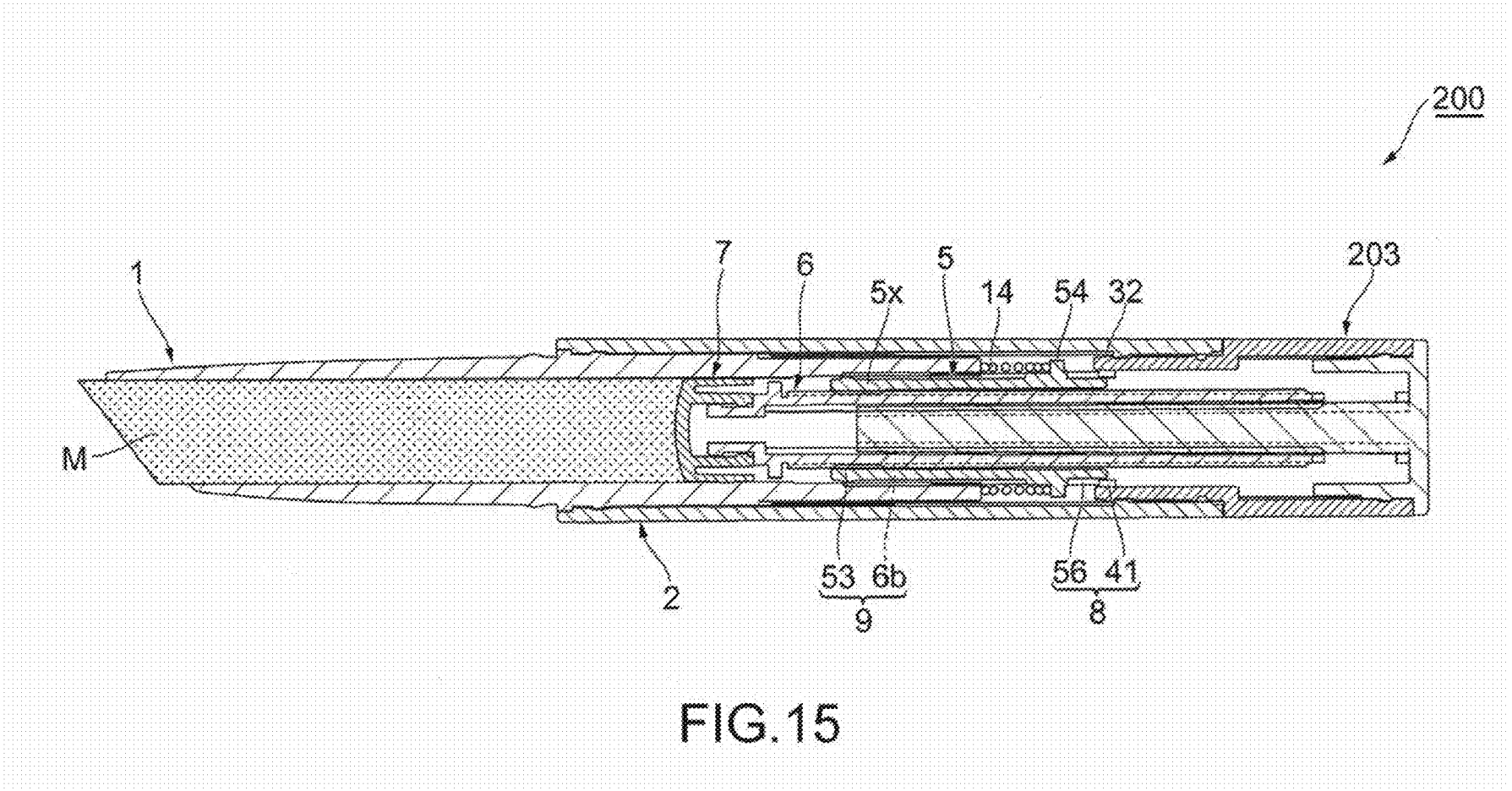
FIG. 15 is a longitudinal sectional view illustrating another example of the container for pushing out applying material as shown in FIG. 1.
Figure 16:
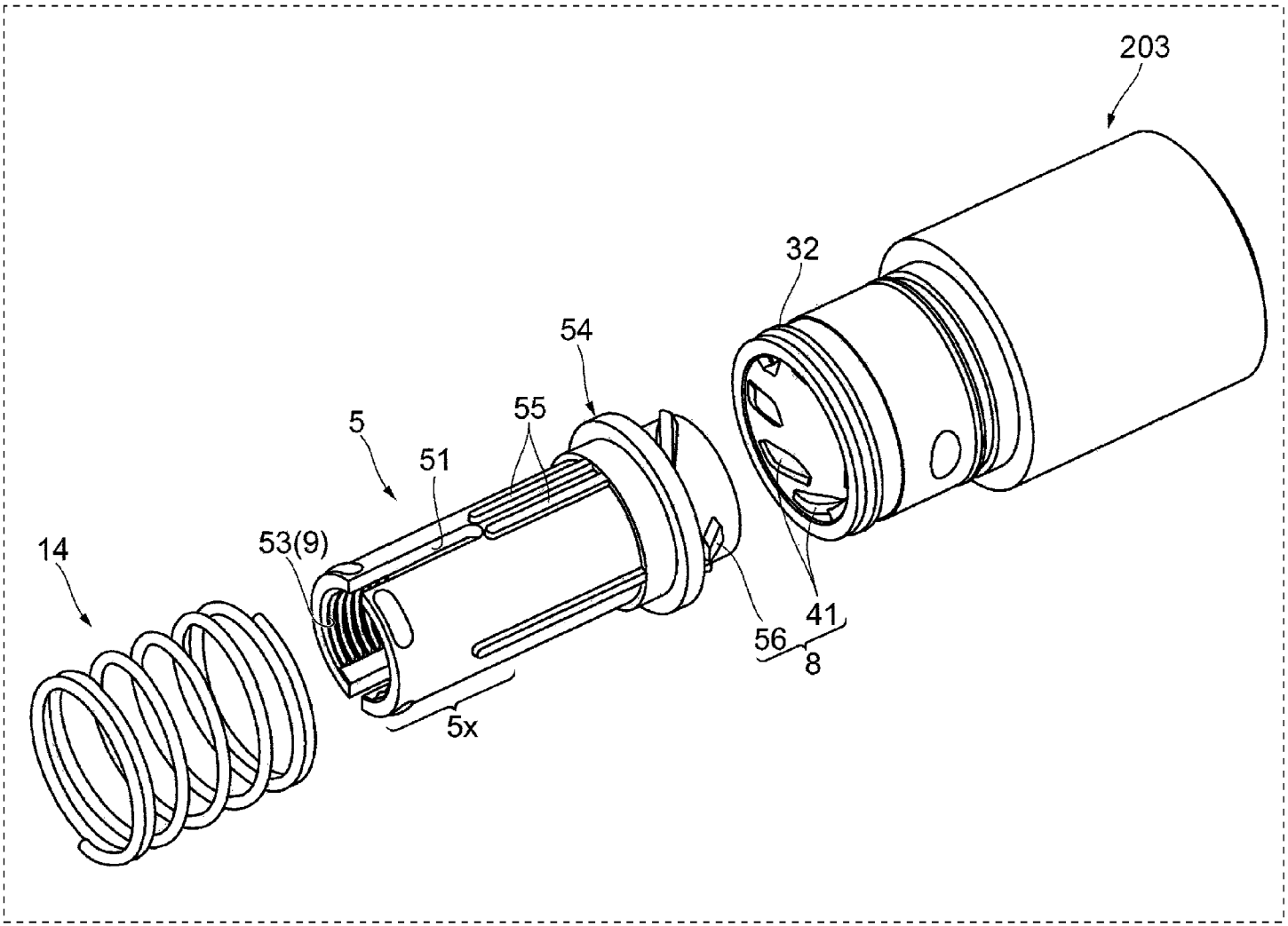
FIG. 16 is a three-dimensional view illustrating the main parts of the container for pushing out applying material as shown in FIG. 15.

As shown in FIGS. 15 and 16 for instance, a container 200 for pushing out applying material as involved in other examples comprises an operation tube 203 that integrates the functions of the aforementioned rotation-stopper tube 4 and operation tube 3. That is to say, the container 200 for pushing out applying material differs from the aforementioned container 100 for pushing out applying material in: the container 200 for pushing out applying material does not have the rotation-stopper tube 4, but has an operation tube 203 in place of the operation tube 3, and a plurality of protrusive strips 41 that constitute the female thread of the first screwing part 8 are provided at the front side of the inner circumferential surface of the operation tube 203.

In the container 200 for pushing out applying material, when the main body tube 2 and the operation tube 3 are relatively rotated toward the first direction, the moveable screw tube 5 advances under the screw function of the first screwing part 8, and the moving body 6 also advances at the same time under the screw function of the second screwing part 9. On the other hand, when the main body tube 2 and the operation tube 203 are relatively rotated toward the second direction, the moveable screw tube 5 retreats under the screw function of the first screwing part 8, and the moving body 6 also retreats at the same time under the screw function of the second screwing part 9. Accordingly, when relative rotation is continued toward the second direction and the moveable screw tube 5 hence retreats for a predetermined amount, the flange part 54 of the moveable screw tube 5 abuts against the front end face of the operation tube 203, the screw function of the first screwing part 8 is stopped, and the screw function of the second screwing part 9 is also stopped.

Moreover, in the container 200 for pushing out applying material, since there is no diameter expanding part 12 (see FIG. 1) as previously mentioned, expansion of the front end part 5*x* of the moveable screw tube 5 can be prevented even if the moveable screw tube 5 is in the retreat limit.

Furthermore, it is also possible to set the height and the shape of the protrusion 36 to be extremely large in engaging force at one direction, so that, when the main body tube 2 and the operation tube 3 are relatively rotated toward the first direction, the operation tube 3 and the rotation-stopper tube 4 are substantively not relatively rotatable.

Moreover, in the above examples, the convex portion 44 is provided on the rotation-stopper tube 4, and the protrusion 36 that engages the convex portion 44 is provided on the operation tube 3, but it is also possible to dispose the convex portion 44 on the operation tube 3 and to dispose the protrusion 36 that engages the convex portion 44 on the rotation-stopper tube 4.

Furthermore, in the above examples, when the main body tube 2 and the operation tube 3 are relatively rotated toward one/another direction, while the first screwing part 8 exerts the screw function the second screwing part 9 also exerts the screw function, but it is also possible for only the second screwing part 9 to exert the screw function after only the first screwing part 8 has exerted the screw function. Moreover, the aforementioned male thread and female thread can not only be thread teeth or thread grooves, but can also be discontinuously arranged protrusion sets, or spirally shaped and discontinuously arranged protrusion sets that function identically as the thread teeth or thread grooves.

Moreover, the applying material M for use in the container for pushing out applying material can be primarily such liquid applying materials as selected from lipstick, lip cosmetics, eye shade, eyeliner, beautifying solution, cleaning solution, nail varnish, nail caring solution, varnish remover, mascara, wrinkle removers, hair dye, cosmetics for hair, oral rinse, massage cream, exfoliating solution, foundation liquid, concealer, face cream, ink for such stationeries as marker pens, liquid medicament, or paste-like substances.

From the foregoing, persons of ordinary skill in the art will appreciate that containers for pushing out applying material that are easily fabricated and ensure the pushing strength of the applying material have been disclosed.

Some such containers for pushing out applying material include a moving body inside the container, and the moving body is screwed on a moveable screw tube via a screwing part; when a front part and a rear part of the container are relatively rotated toward a first direction, the moveable screw tube advances for a predetermined amount, and when the front part and the rear part of the container are further relatively rotated toward the first direction, the screwing part exerts screw function to urge the moving body forward to thereby push the applying material out of an opening at the end of the container. A female thread that constitutes the screwing part is formed at an end side of the moveable screw tube, the end side being so configured that the end side can be radially outwardly expanded with a slit, and that an outer diameter of the end side is restricted and the expansion is hence stopped when the moveable screw tube advances for a predetermined amount.

In the container for pushing out the applying material, the female thread that constitutes the screwing part is formed at the end side of the moveable screw tube, and the end side can radially outwardly expand via the slit, so that it can be pulled perforce during fabrication. Moreover, when the front part and the rear part of the container are relatively rotated toward the first direction and the moveable screw tube advances for a predetermined amount, the outer diameter of the moveable screw tube is restricted and the expansion is stopped, so that when the front part and the rear part of the container are further relatively rotated toward the first direction to urge the moving body forward by means of the screw function of the screwing part, expansion of the end side of the moveable screw tube is suppressed and the expansion of the inner diameter of the female thread is restricted. As a result, when the moving body advances, the screwing part reliably exerts the screw function to thereby generate sufficient pushing strength of the applying material. Consequently, fabrication is made easier, and the pushing strength of the applying material is achieved.

Here, as a preferable structure that exerts the above functional effects, the container comprises a second screwing part in addition to the first screwing part; wherein when a front part and a rear part of the container are relatively rotated toward a direction, the second screwing part exerts screw function to urge the moveable screw tube forward for a predetermined amount, and when the front part and the rear part of the container are further relatively rotated toward the direction, the screwing part exerts screw function to urge the moving body forward to thereby push the applying material out of an opening at an end of the container.

It is preferable that when the front part and the rear part of the container are relatively rotated in a second direction opposite to the first direction, the second screwing part exerts a screw function to urge the moveable screw tube backward for a predetermined amount to thereby release restriction on the outer diameter of the end side of the moveable screw tube. Under such a circumstance, when the front part and the rear part of the container are relatively rotated in the second direction, the other screwing part exerts screw function to urge the moveable screw tube backward for a predetermined amount to thereby release restriction on the outer diameter of the end side of the moveable screw tube. Accordingly, for instance, when the front part and the rear part of the container are relatively rotated in the second direction so that the moving body is located at the retreat limit, even if an excess rotational force is further exerted on the screwing part, since the end side of the moveable screw tube is expanded and the screw function of the screwing part is hence released, damage to the screwing part and its peripheral parts is suppressed.

Moreover, when the front part and the rear part of the container are relatively rotated in the second direction, the second screwing part exerts a screw function to urge the moveable screw tube backward for the predetermined amount, the screw function of the second screwing part stops, and the screw function of the screwing part also stops. By the statement that "the screw function stops" here, it is meant that the thread teeth of the male thread and the female thread abut against one another under the state of engagement so that the screw is inoperative.

Furthermore, it is preferable that when the front part and the rear part of the container are relatively rotated in the second direction, the other screwing part exerts screw function to urge the moveable screw tube backward for the predetermined amount, and the screw function of the second screwing part stops; when the front part and the rear part of the container are further relatively rotated in the second direction, only the screwing part exerts screw function to urge the moving body backward in the state the screw function of the second screwing part stops. Under such a circumstance, even if the front part and the rear part of the container are further relatively rotated toward the second direction when the screw function of the second screwing part stops, no excessive rotational force is exerted on the second screwing part, and the moving body retreats.

It is still preferable that when the front part and the rear part of the container are relatively rotated in the second direction, the second screwing part exerts screw function to urge the moveable screw tube backward for a predetermined amount, and the screw function of the second screwing part is released; when the front part and the rear part of the container are further relatively rotated in the second direction, only the screwing part exerts screw function to urge the moving body backward. Under such a circumstance, since the screw function of the second screwing part is released when the front part and the rear part of the container are relatively rotated toward the second direction, even if the front part and the rear part of the container are further relatively rotated toward the second direction, no excessive rotational force is exerted on the second screwing part, and the moving body retreats. Additionally, by the statement that "the screw function is released" here, it is meant that engagement between the thread teeth of the male thread and the female thread is detached, and the screw function is hence not exerted.

It is noted that this patent claims priority from Japanese Patent Application Serial Number JP2008-278778, which was filed on Oct. 29, 2008, and is hereby incorporated by reference in its entirety.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A container for pushing out applying material, comprising:

a moving body inside the container, the moving body being screwed on a moveable screw tube via a second screwing part, wherein when a front part is rotated relative to a rear part of the container toward a first direction, the moveable screw tube advances by a corresponding amount, and when the front part is further rotated relative to the rear part of the container toward the first direction, the second screwing part exerts a screw function to urge the moving body forward to thereby push the applying material out of an opening at an end of the container, a female thread that constitutes the second screwing part is formed at an end side of the moveable screw tube, the end side being radially outwardly expandable with a slit, and an outer diameter of the end side is restricted and the expansion is hence stopped when the moveable screw tube advances by a predetermined amount.

2. The container for pushing out applying material according to claim 1, wherein the container comprises a first screwing part in addition to the second screwing part; wherein when the front part is rotated relative to the rear part of the container toward the first direction, the first screwing part exerts a screw function to urge the moveable screw tube forward for the corresponding amount, and when the front part is further rotated relative to the rear part of the container toward the first direction, the second screwing part exerts a screw function to urge the moving body forward to thereby push the applying material out of the opening at the end of the container.

3. The container for pushing out applying material according to claim 2, wherein: when the front part is rotated relative to the rear part of the container in a second direction opposite to the first direction, the first screwing part exerts a screw function to urge the moveable screw tube backward for a corresponding amount to thereby release restriction on the outer diameter of the end side of the moveable screw tube.

4. The container for pushing out applying material according to claim 3, wherein: when the front part is rotated relative to the rear part of the container in the second direction, the first screwing part exerts the screw function to urge the moveable screw tube backward for the predetermined amount, the screw function of the first screwing part stops, and the screw function of the second screwing part also stops.

5. The container for pushing out applying material according to claim 3, wherein: when the front part is rotated relative to the rear part of the container in the second direction, the first screwing part exerts the screw function to urge the moveable screw tube backward for the corresponding amount, and the screw function of the first screwing part stops; when the front part is further rotated relative to the rear part of the container in the second direction, only the second screwing part exerts a screw function to urge the moving body backward after the screw function of the first screwing part has stopped.

6. The container for pushing out applying material according to claim 3, wherein: when the front part is rotated relative to the rear part of the container in the second direction, the first screwing part exerts the screw function to urge the moveable screw tube backward for the corresponding amount, and the screw function of the first screwing part is released; when the front part is further rotated relative to the rear part of the container in the second direction, only the second screwing part exerts the screw function to urge the moving body backward.

* * * * *